US008328544B2

(12) United States Patent
Iwano et al.

(10) Patent No.: US 8,328,544 B2
(45) Date of Patent: Dec. 11, 2012

(54) BEARINGS OF A SCROLL TYPE MACHINE WITH CRANK MECHANISM

(75) Inventors: Kiminori Iwano, Yokohama (JP); Kazutaka Suefuji, Kawasaki (JP); Toshikazu Harashima, Tama (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 831 days.

(21) Appl. No.: 12/496,975

(22) Filed: Jul. 2, 2009

(65) Prior Publication Data

US 2010/0166589 A1 Jul. 1, 2010

(30) Foreign Application Priority Data

Dec. 26, 2008 (JP) ..... 2008-332724

(51) Int. Cl.

| | |
|---|---|
| ***F01C 1/02*** | (2006.01) |
| ***F01C 1/063*** | (2006.01) |
| ***F04C 2/02*** | (2006.01) |
| ***F04C 2/063*** | (2006.01) |
| ***F04C 18/02*** | (2006.01) |
| ***F04C 18/063*** | (2006.01) |

(52) U.S. Cl. ..... 418/55.3; 418/55.1

(58) Field of Classification Search ..... 418/55.1–55.6
See application file for complete search history.

(56) References Cited

U.S. PATENT DOCUMENTS

| | | | | |
|---|---|---|---|---|
| 4,715,796 | A * | 12/1987 | Inaba et al. | 418/55.5 |
| 5,403,171 | A * | 4/1995 | Sugita et al. | 418/55.1 |
| 5,951,269 | A * | 9/1999 | Sasa et al. | 418/55.1 |
| 7,467,933 | B2 * | 12/2008 | Ni | 418/55.3 |

FOREIGN PATENT DOCUMENTS

JP 3-141883 A 6/1991

* cited by examiner

*Primary Examiner* — Mary A Davis
(74) *Attorney, Agent, or Firm* — Crowell & Moring LLP

(57) ABSTRACT

The invention reduces a centrifugal force of an orbiting scroll which acts on an auxiliary crank mechanism. A crank pin which is eccentric from a main shaft portion is formed in a drive shaft and attached to an orbiting bearing which is provided in a back face side of an orbiting scroll. The main shaft portion of the drive shaft is rotatably supported by a main bearing. An internal gap of the main bearing is set to a value which is larger than a value obtained by subtracting the double value of an eccentric amount difference between an eccentric amount of an auxiliary crank shaft and an eccentric amount of the drive shaft from an internal gap of the orbiting bearing.

22 Claims, 18 Drawing Sheets

BEARINGS OF A SCROLL TYPE MACHINE WITH CRANK MECHANISM

INCORPORATED BY REFERENCE

The present application claims priority from Japanese application JP2008-332724 filed on Dec. 26, 2008, the content of which is hereby incorporated by reference into this application.

BACKGROUND OF THE INVENTION

The present invention relates to a scroll type fluid machine which is preferably employed in a compressor of a fluid, for example, an air or the like, a vacuum pump, an expansion machine and the like.

Generally, as a scroll fluid machine, there are a compressor compressing a fluid such as an air, a refrigerant or the like, a vacuum pump depressurizing an internal side of a container, an expander expanding the fluid and the like. This kind of scroll type fluid machine is provided with a fixed scroll which is fixed to a casing and is provided in a rising manner with a spiral wrap portion in a surface of a end plate, a orbiting scroll which is provided in a rising manner with a spiral wrap portion in a surface of a end plate and defines a plurality of fluid chambers compressing and expanding a fluid with respect to the fixed scroll on the basis of a orbiting motion, a drive shaft which is rotatably provided in the casing for orbiting the orbiting scroll, and a self-rotation preventing mechanism which prevents a self-rotation of the orbiting scroll and is constructed, for example, by an auxiliary crank mechanism. Further, the drive shaft has a crank pin serving as an eccentric shaft portion which is eccentric from a main shaft portion in a leading end side thereof, and is rotatably attached to the casing via a main bearing.

Further, the scroll type fluid machine drives the orbiting scroll via the drive shaft by a driving source such as a motor or the like. Accordingly, the scroll type fluid machine sequentially compresses a fluid, for example, the air, the refrigerant or the like within each of fluid chambers.

Further, as the scroll type fluid machine, there has been known a structure in which an annular elastic member is provided between a main bearing and a drive shaft, for enabling a load acting on a crank pin and a wrap at a time of an abnormal load to avoiding in all the radial directions (refer, for example, to JP-A-3-141883).

SUMMARY OF THE INVENTION

In the meantime, in the scroll type fluid machine in accordance with the prior art, a centrifugal force is generated in connection with the orbiting motion of the orbiting scroll. The centrifugal force of the orbiting scroll is structured such as to be shared and supported by the main bearing supporting the drive shaft and an auxiliary crank mechanism. Accordingly, for example, when the orbiting scroll carries out a orbiting motion at a high speed, an excessive centrifugal force acts on the auxiliary crank mechanism, and there is a risk that a durability of the auxiliary crank mechanism is lowered.

On the other hand, in the structure of the patent document 1, since the annular elastic member is provided between the main bearing and the drive shaft, it is possible to directly apply a centrifugal force of a balance weight to the orbiting scroll. Accordingly, since it is possible to reduce the centrifugal force of the orbiting scroll by the centrifugal force of the balance weight, it is possible to reduce the centrifugal force acting on the auxiliary crank mechanism.

However, in the structure of the patent document 1, since the annular elastic member is provided between the main bearing and the drive shaft, it is impossible to set a spring constant of the annular elastic member to 0, and the main bearing is exposed to a part of the load caused by the centrifugal force. Accordingly, there is generated a problem that an equivalent load to the load acting on the main bearing by the centrifugal force acts on the auxiliary crank bearing supporting the auxiliary crank.

The present invention is made by taking the problem of the prior art mentioned above into consideration, and an object of the present invention is to provide a scroll type fluid machine which can reduce a centrifugal force of a orbiting scroll acting on an auxiliary crank mechanism.

In accordance with the present invention, there is provided a scroll type fluid machine comprising:

a casing;

a fixed scroll which is provided in the casing and is provided in a rising manner with a spiral wrap portion in a surface of a end plate;

a orbiting scroll which is provided in a rising manner with a spiral wrap portion overwrapping the wrap portion of the fixed scroll in a surface of a end plate, and defines a plurality of fluid chambers compressing or expanding a fluid with respect to the fixed scroll on the basis of a orbiting motion;

a drive shaft which has a main shaft portion rotatably provided in the casing via a main bearing and an eccentric shaft portion provided eccentrically in a leading end side of the main shaft portion and attached to the orbiting scroll via a orbiting bearing;

a balance weight which is coupled to the drive shaft and cancels a centrifugal force of the orbiting scroll; and a self-rotation preventing mechanism which prevents a self-rotation of the orbiting scroll, wherein the self-rotation preventing mechanism is constructed by a first auxiliary crank bearing which is provided in the casing side or the fixed scroll side, a second auxiliary crank bearing which is provided in the orbiting scroll side, and an auxiliary crank shaft in which one side shaft portion is rotatably supported by the first auxiliary crank bearing, and the other side shaft portion is rotatably supported by the second auxiliary crank bearing.

Further, a feature of the structure employed by claim 1 exists in a structure in which a diametrical gap ($\delta b$) of the main bearing is larger than a diametrical gap ($\delta a$) of the orbiting bearing.

Further, a feature of the structure employed by claim 8 exists in a structure in which a diametrical gap ($\delta b$) of the main bearing is larger than a difference between a diametrical gap ($\delta a$) of the orbiting bearing and a twofold value of an eccentric amount difference ($\epsilon'-\epsilon$) between an eccentric amount ($\epsilon'$) of the auxiliary crank shaft and an eccentric amount ($\epsilon$) of the drive shaft.

Further, a feature of the structure employed by claim 16 exists in a structure in which a diametrical gap ($\delta b$) of the main bearing is 15 μm or more larger than a difference between a diametrical gap ($\delta a$) of the orbiting bearing and a twofold value of an eccentric amount difference ($\epsilon'-\epsilon$) between an eccentric amount ($\epsilon'$) of the auxiliary crank shaft and an eccentric amount ($\epsilon$) of the drive shaft.

In accordance with the present invention, it is possible to reduce the centrifugal force of the orbiting scroll acting on the auxiliary crank mechanism.

Other objects, features and advantages of the invention will become apparent from the following description of the embodiments of the invention taken in conjunction with the accompanying drawings.

DETAILED DESCRIPTION OF PREFERRED EMBODIMENTS

A nonlubricated scroll type air compressor is exemplified as a scroll type fluid machine in accordance with an embodiment of the present invention, and will be in detail described below in accordance with the accompanying drawings.

Figure 1:
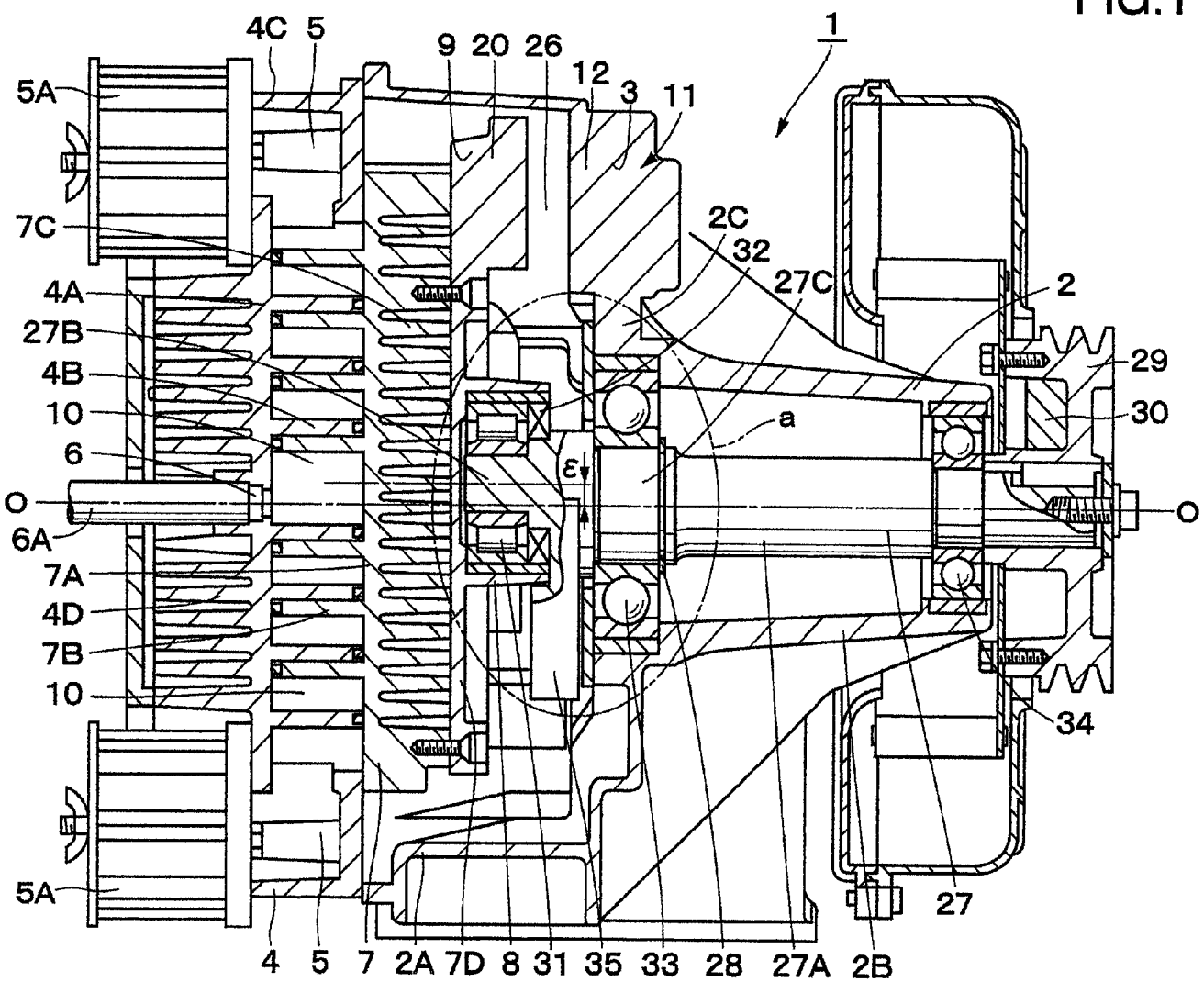
FIG. 1 is a vertical cross sectional view showing a scroll type air compressor in accordance with a first embodiment of the present invention.

First of all, FIGS. 1 to 7 show a first embodiment in accordance with the present invention. In FIG. 1, reference numeral 1 denotes a scroll type air compressor compressing an air. The scroll type air compressor 1 is roughly constructed by a casing 2 mentioned below, a fixed scroll 4, a orbiting scroll 7, an auxiliary crank mechanism 11, a drive shaft 27 and the like.

Reference numeral 2 denotes a casing forming an outer frame of the scroll type air compressor 1. The casing is formed as a stepped tubular body in which one side in an axial direction is approximately closed, and the other side is open. Further, the casing 2 is roughly constructed by a large-diameter tube portion 2A, a small-diameter bearing tube portion 2B which is formed as a tubular shape having a smaller diameter than the large-diameter tube portion 2A and protrudes outward from one side in an axial direction of the large-diameter tube portion 2A, and an annular portion 2C which is formed between the bearing tube portion 2B and the large-diameter tube portion 2A.

Further, fixed side bearing accommodating portions 3 are provided in an outer peripheral side of the casing 2 so as to be spaced in a peripheral direction, for example, at three positions (illustrated at only one position). Further, the bearing accommodating portion 3 is formed by a stepped circular hole which is open in the orbiting scroll 7 side, and accommodates a first auxiliary crank bearing 12 of an auxiliary crank mechanism 11 mentioned below in an inner portion thereof.

Reference numeral 4 denotes a fixed scroll which is provided in the other side of the casing 2. The fixed scroll 4 is fixed to an open end of the large-diameter tube portion 2A in such a manner as to close the large-diameter tube portion 2A of the casing 2 from the other side in the axial direction. Further, the fixed scroll 4 is roughly constructed by a end plate 4A which is formed as an approximately circular plate shape around an axis O-O, a spiral wrap portion 4B which is provided in a rising manner in an axial direction in a surface of the end plate 4A, a tube portion 4C which is provided in an outer peripheral side of the end plate 4A so as to surround the wrap portion 4B, and a plurality of cooling fans 4D which are provided in a protruding manner in a back face of the end plate 4A.

Reference numeral 5 denotes a suction port which is provided in the fixed scroll 4. For example, two suction ports are provided. Each of the suction ports 5 is open from an outer peripheral side of the end plate 4A toward the tube portion 4C, and is communicated with an outer peripheral side compression chamber 10 mentioned below. Further, the suction port 5 is structured such as to circulate the air into the outer peripheral side compression chamber 10 through a suction filter 5A.

Reference numeral 6 denotes a discharge port which is provided in a center side of the end plate 4A of the fixed scroll 4. The discharge port 6 is communicated with the compression chamber 10 closest to the center side, and discharges the compressed air within the compression chamber 10 to an external portion from a discharge pipe 6A.

Reference numeral 7 denotes a orbiting scroll which is provided within the large-diameter tube portion 2A of the casing 2 in a freely orbiting manner so as to oppose to the fixed scroll 4. The orbiting scroll 7 is roughly constructed by an approximately circular plate-shaped end plate 7A which is arranged so as to oppose to the end plate 4A of the fixed scroll 4, a spiral wrap portion 7B which is provided in a rising manner in a surface of the end plate 7A, a plurality of cooling fins 7C which are provided in a protruding manner in a back face of the end plate 7A, and a back face plate 7D which is fixed so as to be positioned at a leading end side of the cooling fin 7C.

Further, a closed-end tubular boss portion 8 rotatably coupled to a crank pin 27B of a drive shaft 27 mentioned below is integrally formed in a center side of the back face plate 7D. Further, a orbiting side bearing accommodating portion 9 is provided in an outer peripheral side of the back face plate 7D. For example, three orbiting side bearing accommodating portions 9 are provided at corresponding positions to the fixed side bearing accommodating portions 3 (illustrated at only one position). Further, the bearing accommodating portion 9 is formed by a closed-end circular hole which is open in the annular portion 2C side of the casing 2, and accommodates a second auxiliary crank bearing 20 of an auxiliary crank mechanism 11 mentioned below in an inner portion thereof.

Reference numeral 10 denotes a plurality of compression chambers which serve as a fluid chamber provided between the fixed scroll 4 and the orbiting scroll 7. The compression chambers 10 move from the outer peripheral side of the wrap portions 4B and 7B toward the center side at a time when the orbiting scroll 7 orbits, and are continuously contracted therebetween. Accordingly, the air is sucked into the outer peripheral side compression chamber 10 in each of the compression chambers 10 from the suction port 5, and the air is compressed until it reaches the center side compression chamber 10. Further, the compressed air is discharged from a discharge port 6, and is reserved in an external air tank (not shown) or the like via a discharge pipe 6A.

Figure 3:
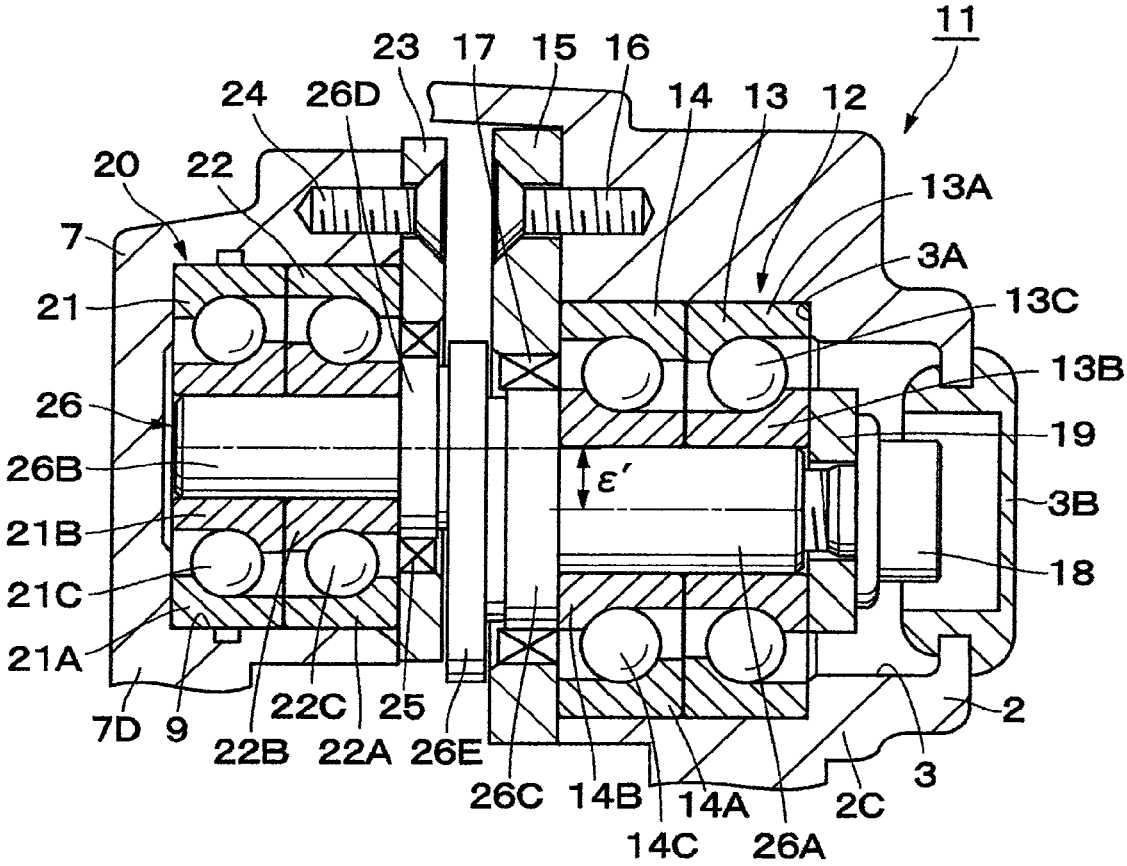
FIG. 3 is an enlarged vertical cross sectional view showing an auxiliary crank mechanism in FIG. 1 in an enlarged manner.

Reference numeral 11 denotes an auxiliary crank mechanism which serves as a self-rotation preventing mechanism. For example, three auxiliary crank mechanisms are arranged so as to be spaced in a peripheral direction between the annular portion 2C of the casing 2 and the orbiting scroll 7 (only one is illustrated). These auxiliary crank mechanisms 11 are roughly constructed by first and second auxiliary crank bearings 12 and 20 mentioned below and an auxiliary crank shaft 26, as shown in FIGS. 1 and 3.

In this case, the first auxiliary crank bearing 12 is accommodated within the bearing accommodating portion 3 of the casing 2. On the other hand, the second auxiliary crank bearing 20 is accommodated within the bearing accommodating portion 9 of the orbiting scroll 7. Further, the auxiliary crank shaft 26 is eccentric by an eccentric amount $\epsilon'$, and is rotatably supported in its both end sides by the first and second auxiliary crank bearings 12 and 20. Accordingly, the auxiliary crank mechanism 11 prevents the orbiting scroll 7 from rotating on its own axis at a time when the orbiting scroll 7 orbits on the basis of a rotational drive of the drive shaft 27.

Reference numeral 12 denotes a first auxiliary crank bearing which is accommodated within the bearing accommodating portion 3 of the casing 2 and serves as a casing side ball bearing. The first auxiliary crank bearing 12 is constructed by a back-to-back duplex angular ball bearing by back-to-back joining a first angular ball bearing 13 positioned in a bottom portion side of the bearing accommodating portion 3, and a second angular ball bearing 14 positioned in an opening portion side of the bearing accommodating portion 3.

In this case, the first angular ball bearing 13 is constructed by an outer lace 13A which is positioned in an outer side in a radial direction, an inner lace 13B which is positioned in an inner side in the radial direction, and a plurality of rolling elements which are arranged between the outer lace 13A and the inner lace 13B. Further, the second angular ball bearing 14 is also constructed by an outer lace 14A, an inner lace 14B and steel balls 14C approximately in the same manner as the first angular ball bearing 13.

Further, the outer laces 13A and 14A are pressure inserted to the bearing accommodating portion 3 of the casing 2 so as to be non-displaceable in an axial direction and a radial direction. Further, the outer lace 13A comes into contact with the annular step portion 3A in the bottom face side of the bearing accommodating portion 3, and the outer lace 14A comes into contact with a presser plate 15 constructed by an annular end plate, and is fixed into the bearing accommodating portion 3 in a come-off preventing state.

At this time, the presser plate 15 is arranged in an opening side of the bearing accommodating portion 3, and is attached to the casing 2 by a bolt 16. Further, a slight clearance is formed between the presser plate 15 and an opening portion end surface of the bearing accommodating portion 3 of the casing 2, for securely bringing the presser plate 15 into contact with the outer lace 14A of the first auxiliary crank bearing 12. Accordingly, the first auxiliary crank bearing 12 is fixed by the bearing accommodating portion 3 so as to be non-displaceable in the radial direction, and is fixed by the annular step portion 3A of the bearing accommodating portion 3 and the presser plate 15.

Further, an annular seal member 17 is provided in an inner peripheral side of the presser plate 15. Further, the seal member 17 comes into slidable contact with an outer peripheral surface of a flange portion 26C of the auxiliary crank shaft 26, and prevents a lubricating oil filled between the outer laces 13A and 14A and the inner laces 13B and 14B of the first auxiliary crank bearing 12 from leaking.

On the other hand, a preload is given to the inner laces 13B and 14B by using a bolt 18, and a fixed side shaft portion 26A of the auxiliary crank shaft 26 is attached thereto. In this case, the bolt 18 is screwed to the fixed side shaft portion 26A of the auxiliary crank shaft 26, and a washer 19 is interposed between the bolt 18 and the fixed side shaft portion 26A. Further, the washer 19 comes into contact with the inner lace 13B of the first auxiliary crank bearing 12.

Accordingly, the fixed side shaft portion 26A of the auxiliary crank shaft 26 is fixed to the inner laces 13B and 14B while giving the preload to the inner laces 13B and 14B of the first auxiliary crank bearing 12, by fastening the bolt 18. As a result, a bearing gap between the outer laces 13A and 14A and the steel balls 13C and 14C and a bearing gap between the inner laces 13B and 14B and the steel balls 13C and 14C which construct an internal gap of the first auxiliary crank bearing 12 become both smaller. Further, the bolt 18 and the washer 19 serve as a fixing member for fixing the auxiliary crank shaft 26 to the first auxiliary crank bearing 12.

Reference numeral 20 denotes a second auxiliary crank bearing which is accommodated within the bearing accommodating portion 9 of the orbiting scroll 7 and serves as a scroll side ball bearing. The second auxiliary crank bearing 20 is constructed as a face-to-face duplex angular ball bearing by face-to-face joining a first angular ball bearing 21 which is positioned in a bottom portion side of the bearing accommodating portion 9, and a second angular ball bearing 22 which is positioned in an opening portion side. In other words, a bearing gap between the angular ball bearings 21 and 22 comes to 0, does not rattle in either of the radial direction and the axial direction, and can support the load.

In this case, the first angular ball bearing 21 is constructed by an outer lace 21A which is positioned in an outer side in a radial direction, an inner lace 21B which is positioned in an inner side in the radial direction, and a plurality of steel balls 21C which are arranged between the outer lace 21A and the inner lace 21B and come to rolling elements. Further, the second angular ball bearing 22 is constructed, by an outer lace 22A, an inner lace 22B and steel balls 22C approximately in the same manner as the first angular ball bearing 21.

Further, the outer laces 21A and 22A are pressure inserted into the bearing accommodating portion 9 of the orbiting scroll 7 so as to be non-displaceable in the axial direction and the radial direction. Further, the outer lace 21A comes into contact with the bottom face of the bearing accommodating portion 9, and a preload is given to the outer lace 22A by a presser plate 23 which is constructed by an annular end plate.

At this time, the presser plate 23 is arranged in the opening side of the bearing accommodating portion 9, and is attached to the orbiting scroll 7 by a bolt 24. Further, a slight clearance is formed between the presser plate 23 and the opening portion end surface of the orbiting scroll 7, for securely bringing the presser plate 23 into contact with the outer lace 22A of the second auxiliary crank bearing 20. Accordingly, the second auxiliary crank bearing 20 is fixed by the bearing accommodating portion 9 so as to be non-displaceable in the radial direction, and is fixed by the bottom face of the bearing accommodating portion 9 and the presser plate 23 so as to be non-displaceable in the axial direction.

Further, a preload is given to the outer laces 21A and 22A of the second auxiliary crank bearing 20 by fastening the bolt 24. As a result, a bearing gap between the outer laces 21A and 22A and the steel balls 21C and 22C and a bearing gap between the inner laces 21B and 22B and the steel balls 21C and 22C which construct an internal gap of the second auxiliary crank bearing 20 become both smaller.

Further, an annular seal member 25 is provided in an inner peripheral side of the presser plate 23. Further, the seal member 25 comes into slidable contact with an outer peripheral surface of the flange portion 26D of the auxiliary crank shaft 26, and prevents a lubricating oil filled between the outer laces 21A and 22A and the inner laces 21B and 22B of the second auxiliary crank bearing 20 from leaking.

Reference numeral 26 denotes an auxiliary crank shaft which is provided between the first and second auxiliary crank bearings 12 and 20. The auxiliary crank shaft 26 is provided with a fixed side shaft portion 26A which is rotatably supported to the first auxiliary crank bearing 12 and serves as one side shaft portion, a orbiting side shaft portion 26B which is rotatably supported to the second auxiliary crank bearing 20 and serves as the other side shaft portion, a fixed side flange portion 26C which is formed as a collar shape in a base end portion side of the fixed side shaft portion 26A, and a orbiting side flange portion 26D which is formed as a collar shape in a base end portion side of the orbiting side shaft portion 26B. Further, the flange portions 26C and 26D are connected to each other by using a connecting portion 26E.

Further, an axis of the fixed side shaft portion 26A and an axis of the orbiting side shaft portion 26B are formed eccentrically with each other, and an eccentric amount $\epsilon'$ between the shaft portions 26A and 26B is set to a value which is, for example, about some hundreds μm (for example, about 100 to 300 μm) larger than an eccentric amount $\epsilon$ of the drive shaft 27 ($\epsilon'>\epsilon$).

In this case, the fixed side shaft portion 26A is attached to the inner laces 13B and 14B by fastening the bolt 18 so as to pinch the inner laces 13B and 14B of the first auxiliary crank bearing 12 between the washer 19 and the flange portion 26C. Further, the outer laces 13A and 14A of the first auxiliary crank bearing 12 are fixed to the bearing accommodating portion 3 by the presser plate 15. Accordingly, the fixed side shaft portion 26A is attached to the first auxiliary crank bearing 12 in a state of being immovable in the radial direction and the axial direction.

On the other hand, the orbiting side shaft portion 26B is attached to the inner laces 21B and 22B in a state of being immovable in the radial direction and the axial direction by being pressure inserted to the inner laces 21B and 22B of the second auxiliary crank bearing 20. Further, the outer laces 21A and 22A of the second auxiliary crank bearing 20 are fixed to the bearing accommodating portion 9 by the presser plate 23. Accordingly, the orbiting side shaft portion 26B is attached to the second auxiliary crank bearing 20 in a state of being immovable in the radial direction and the axial direction.

Further, the fixed side shaft portion 26A is rotatably supported within the bearing accommodating portion 3 of the casing 2 via the first auxiliary crank bearing 12, and the orbiting side shaft portion 26B is rotatably supported to the bearing accommodating portion 9 close to the orbiting scroll 7 via the second auxiliary crank bearing 20. Accordingly, the auxiliary crank shaft 26 prevents the orbiting scroll 7 from rotating on its own axis at a time when the orbiting scroll 7 orbits on the basis of the rotational drive of the drive shaft 27.

Further, the fixed side flange portion 26C comes into contact with the axial end surface of the inner lace 14B of the first auxiliary crank bearing 12. Further, the orbiting side flange portion 26D comes into contact with the axial end surface of the inner lace 22B of the second auxiliary crank bearing 20. Accordingly, in the case that a thrust load (a thrust force) in an axial direction acts on the orbiting scroll 7 on the basis of the pressure of the compression chamber 10, the thrust load acts on the orbiting side flange portion 26D through the second auxiliary crank bearing 20. Further, the thrust load acting on the auxiliary crank shaft 26 acts on the first auxiliary crank bearing 12 through the fixed side flange portion 26C, and is finally supported by the casing 2.

Reference numeral 27 denotes a drive shaft which is rotatably provided within the bearing tube portion 2B of the casing 2. The drive shaft 27 is rotated around an axis O-O by being driven by an electric motor (not shown), and is structured such as to drive the orbiting scroll 7.

Figure 2:
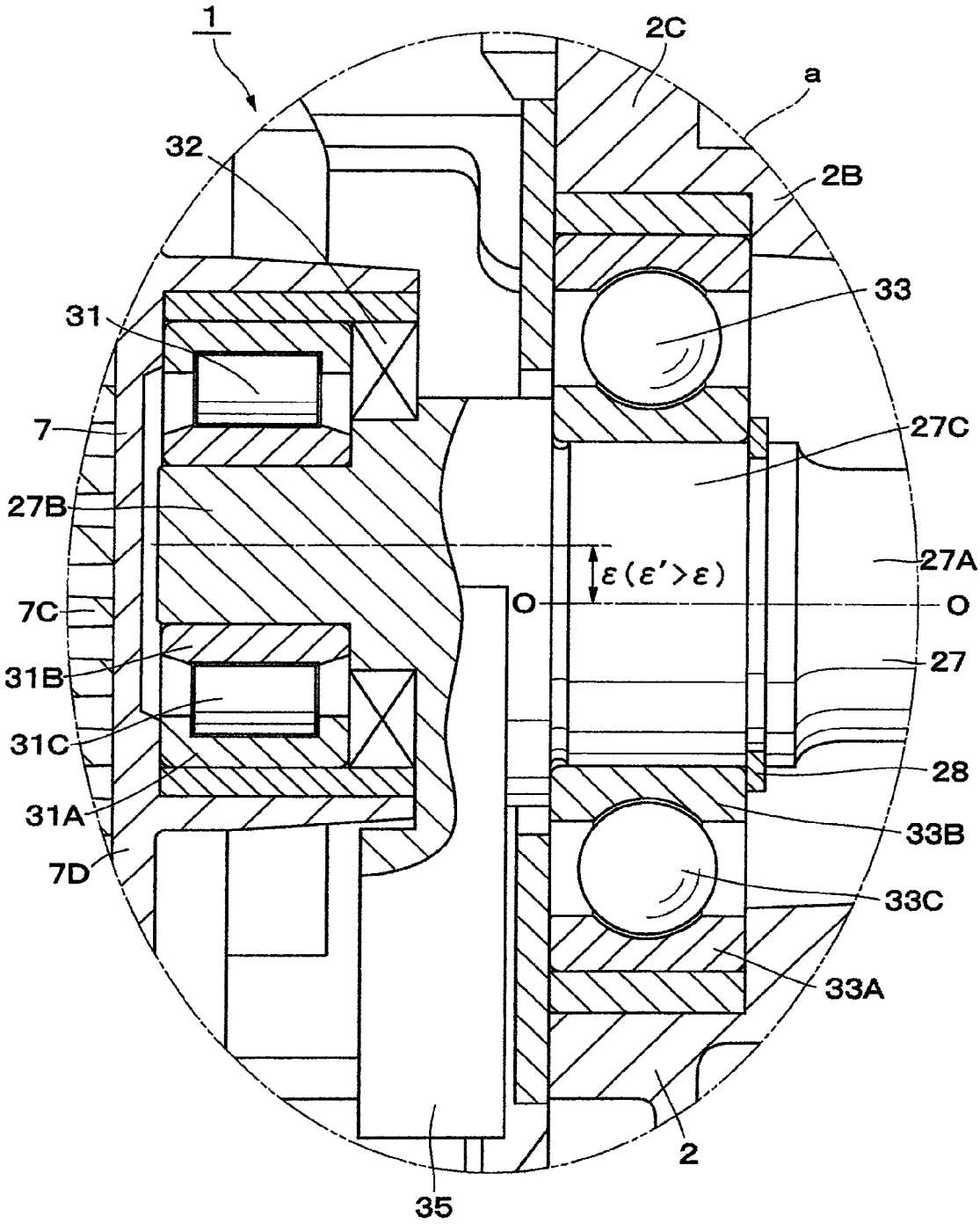
FIG. 2 is an enlarged vertical cross sectional view showing a periphery of a main bearing in FIG. 1 in an enlarged manner.

In this case, the drive shaft 27 has a main shaft portion 27A which is rotatably provided in the casing 2 via a main bearing 33 mentioned below, and a crank pin 27B which is provided eccentrically in a leading end side of the main shaft portion 27A, is attached to a orbiting bearing 31 mentioned below and serves as an eccentric shaft portion, as shown in FIGS. 1 and 2. At this time, the crank pin 27B is eccentric in a radial direction by a fixed eccentric amount $\epsilon$ with respect to an axis O-O passing through a center of the main shaft portion 27A. Further, the crank pin 27B is formed as a circular columnar shape, and is rotatably coupled to the boss portion 8 of the orbiting scroll 7 via the orbiting bearing 31.

Further, a main balance weight 35 mentioned below is attached to the drive shaft 27 so as to be positioned in a base end side of the crank pin 27B. Further, a bearing attaching portion 27C to which the main bearing 33 is attached is formed near of the main balance weight 35 in the drive shaft 27, so as to be positioned in an opposite side to the crank pin 27B while sandwiching the main balance weight 35 with respect to the axial direction. Further, a washer 28 is attached to a base end side of the bearing attaching portion 27C.

Further, a base end side of the drive shaft 27 protrudes to an outer portion of the casing 2, and a pulley 29 is attached to the protruding portion. Further, a sub balance weight 30 is provided in an inner portion of the pulley 29 so as to be displaced in a radial direction from the axis O-O. At this time, the sub balance weight 30 is structured such as to keep a rotational balance of the drive shaft 27 together with a main balance weight 35 mentioned below. Further, the pulley 29 is connected to an output side of the motor via a belt (not shown) or the like. Accordingly, the drive shaft 27 is transmitted a driving force from the motor via the pulley 29, and is rotationally driven around the axis O-O.

Reference numeral 31 denotes a orbiting bearing which is provided in the boss portion 8 so as to be positioned in a back face side of the end plate 7A of the orbiting scroll 7.

Figure 4:
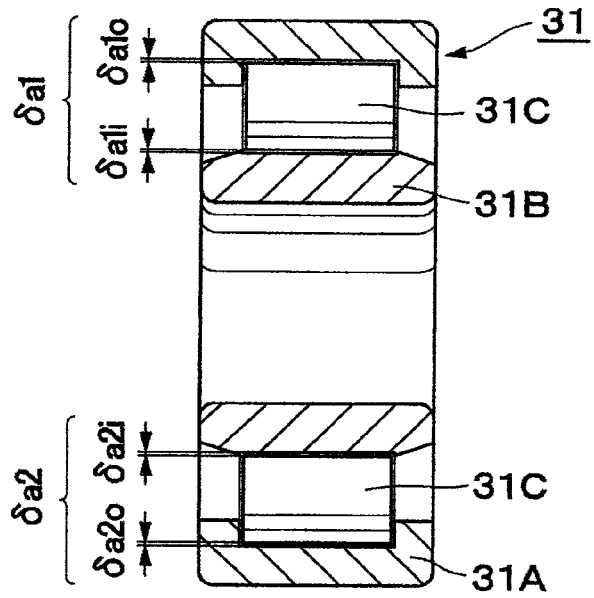
FIG. 4 is a cross sectional view showing a orbiting bearing in FIG. 1 by a simple substance.

In this case, the orbiting bearing 31 is formed, for example, by using a cylindrical roller bearing, as shown in FIGS. 2 and 4. Accordingly, the orbiting bearing 31 is constructed by an outer lace 31A which is positioned in an outer side in a radial direction, an inner lace 31B which is positioned in an inner side in the radial direction, and columnar rollers 31C which are arranged between the outer lace 31A and the inner lace 31B and come to a plurality of rolling elements.

At this time, the outer lace 31A is attached, for example, within the boss portion 8 of the orbiting scroll 7 so as to be non-displaceable in the axial direction and the radial direction. On the other hand, the inner lace 31B is attached to the crank pin 27B of the drive shaft 27, for example, in accordance with a tight fit or the like.

Further, the orbiting bearing 31 has an internal gap δa, for example, about some tens μm, and is structured such that the roller 31C can displace between the outer lace 31A and the inner lace 31B in a range about some tens μm with respect to the radial direction. At this time, a dimension of the internal gap δa comes to a value obtained by adding bearing gaps δa1*o* and δa2*o* between the outer lace 31A and the roller 31C, and bearing gaps δa1*i* and δa2*i* between the inner lace 31B and the roller 31C, as shown by the following numerical expression 1. In other words, the dimension of the internal gap δa comes to a value obtained by adding one side gap δa1 (δa1=δa1*o*+δa1*i*) and the other side gapδa2 (δa2=δa2*o*+δa2*i*) in the radial direction.

$$\delta a=(\delta a1o+\delta a1i)+(\delta a2o+\delta a2i)$$

$$\delta a=\delta a1+\delta a2 \qquad \text{Numerical Expression 1}$$

Accordingly, the orbiting bearing 31 rotatably supports the orbiting scroll 7 with respect to the crank pin 27B of the drive shaft 27 by a degree of freedom of the internal gap δa toward the radial direction. In other words, the internal gap δa serving as the diametrical gap is formed in the orbiting bearing 31.

Further, an oil seal 32 is provided in an opening side of the boss portion 8 so as to be positioned in one end side in the axial direction of the orbiting bearing 31. Further, the oil seal 32 prevents a lubricant such as a grease or the like from leaking out of the orbiting bearing 31.

Figure 5:
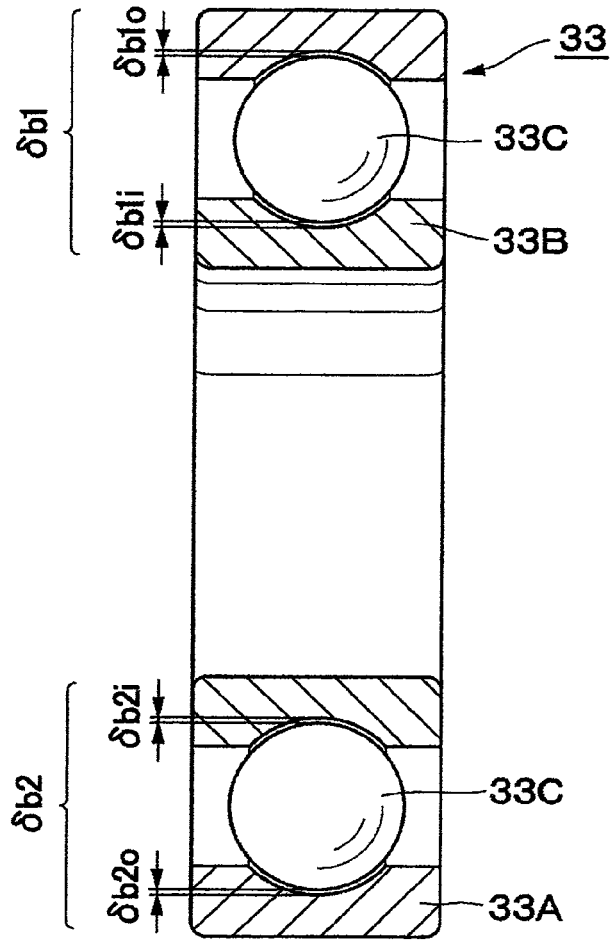
FIG. 5 is a cross sectional view showing a main bearing in FIG. 1 by a simple substance.

Reference numeral 33 denotes a main bearing which is provided within the bearing tube portion 2B of the casing 2 and serves as a first bearing. The main bearing 33 is positioned in the other end side in the axial direction in the bearing tube portion 2B and rotatably supports a leading end side of the drive shaft 27, as shown in FIGS. 2 and 5. In this case, the main bearing 33 is constructed, for example, by a deep groove ball bearing which serves as a ball bearing. Accordingly, the main bearing 33 is constructed by an outer lace 33A which is fixed to the bearing tube portion 2B of the casing 2, for example, by a pressure insertion or the like, an inner lace 33B which is provided in an inner peripheral side of the outer lace 33A, and spherical bodies 33C which rotatably couple the outer lace 33A and the inner lace 33B, serve as a plurality of rolling elements and are constructed by steel balls or the like.

At this time, the outer lace 33A is attached, for example, within the bearing tube portion 3 of the casing 2 so as to be non-displaceable in the axial direction and the radial direction. On the other hand, the inner lace 33B is attached to the bearing attaching portion 27C of the drive shaft 27, for example, by a tight fit or the like.

Further, a deep groove accommodating the spherical body 33C with a degree of freedom in the radial direction is formed in an inner peripheral surface of the outer lace 33A and an outer peripheral surface of the inner lace 33B. Accordingly, the main bearing 33 has an internal gap δb, for example, about some tens μm, and the spherical body 33C can displace between the outer lace 33A and the inner lace 33B in a range about some tens μm with respect to the radial direction. At this time, a dimension of the internal gap δb comes to a value obtained by adding bearing gaps δb1*o* and δb2*o* between the outer lace 33A and the spherical body 33C, and bearing gaps δb1*i* and δb2*i* between the inner lace 33B and the spherical body 33C, as shown by the following numerical expression 2. In other words, the dimension of the internal gap δb comes to a value obtained by adding one side gap δb1 (δb1=δb1*o*+δb1*i*) and the other side gapδb2 (δb2=δb2*o*+δb2*i*) in the radial direction.

$$\delta b=(\delta b1o+\delta b1i)+(\delta b2o+\delta b2i)$$

$$\delta b=\delta b1+\delta b2 \qquad \text{Numerical Expression 2}$$

Accordingly, the orbiting bearing 33 rotatably supports the leading end side of the main shaft portion 27A of the drive shaft 27 with respect to the casing 2 by a degree of freedom of the internal gap δb toward the radial direction. In other words, the internal gap δb serving as the diametrical gap is formed in the main bearing 33.

Further, the diametrical gap (the internal gap δb) of the main bearing 33, and the diametrical gap (the internal gap δa) of the orbiting bearing 31 are set to the dimensions of the internal gaps δa and δb within such a range that the following numerical expression 3 is established.

$$\delta b>(\delta a-2\times(\epsilon'-\epsilon)$$

$$\delta b>(\delta a-2\times\Delta\epsilon) \qquad \text{Numerical Expression 3}$$

In other words, in the case that the difference between the eccentric amount ϵ' of the auxiliary crank shaft 26 and the eccentric amount ϵ of the drive shaft 27 is set to an eccentric amount difference Δϵ (Δϵ=ϵ'−ϵ), the internal gap δb of the main bearing 33 is set to a value which is larger than a value obtained by subtracting a double eccentric amount difference Δϵ from the internal gap δa of the orbiting bearing 31.

In this case, the bearings 31 and 33 do not run into a plastic deformation such as a plastic region at a time of being assembled in the orbiting scroll 7, the casing 2 and the like to be assembled, but are assembled within an elastically deforming range such as an elastic region. In other words, the outer lace 31A of the orbiting bearing 31 is attached to the boss portion 8 of the orbiting scroll 7 in the elastic region, and the inner lace 31B is attached to the crank pin 27B of the drive shaft 27 in the elastic region. Further, the outer lace 33A of the main bearing 33 is attached to the bearing tube portion 2B of the casing 2 in the elastic region, and the inner lace 31B is attached to the main shaft portion 27A of the drive shaft 27 in the elastic region.

Accordingly, the internal gaps δa and δb of the bearings 31 and 33 shown in the numerical expression 3 indicate the gap dimensions in the inner portions of the bearings 31 and 33 before the compressor 1 is driven (at a time when the compressor 1 stops) after the assembly in the elastic region.

Reference numeral 34 denotes an opposed load side bearing which is provided within the bearing tube portion 2B of the casing 2 and serves as a second bearing. The opposed load side bearing 34 is positioned in one end side in an axial direction in the bearing tube portion 2B and rotatably supports a base end side of the main shaft portion 27A of the drive shaft 27, as shown in FIG. 1. Accordingly, the bearings 33 and 34 are arranged in both end sides of the main shaft portion 27A, and rotatably support the drive shaft 27 around the axis O-O.

Reference numeral 35 denotes a main balance weight which is provided in a base end side of the crank pin 27B in the drive shaft 27 and serves as a balance weight. The main balance weight 35 is arranged in an opposite side to the crank pin 27B and the sub balance weight 30 while sandwiching the rotational center (the axis O-O) of the drive shaft 27 with respect to the radial direction. In other words, the main balance weight 35 is arranged in an inverse direction to an eccentric direction of the crank pin 27B while sandwiching the rotational center of the drive shaft 27 with respect to the radial direction. Further, the main balance weight 35 is formed, for example, as an approximately fan shape, and a substantial part thereof is firmly attaché to the drive shaft 27. Further, the main balance weight 35 rotates together with the drive shaft 27 so as to keep a rotational balance of the drive shaft 27.

The scroll type air compressor 1 in accordance with the first embodiment has the structure as mentioned above, and a description will be given next of a motion thereof.

First of all, if the drive shaft 27 is rotated by an electric motor, and the orbiting scroll 7 is driven via the orbiting bearing 31, the compression chamber 10 defined between the wrap portion 4B of the fixed scroll 4 and the wrap portion 7B of the orbiting scroll 7 is continuously contracted. Accordingly, an ambient air sucked from the suction port 5 is sequentially compressed in each of the compressor chambers 10, thereby being discharged as the compressed air from the discharge port 6, so that the ambient air can be reserved in an external air tank or the like.

At a time of this compressing operation, each of the auxiliary crank mechanisms 11 drives the orbiting scroll 7 with respect to the fixed scroll 4, while preventing a self-rotation of the orbiting scroll 7. Further, at a time of the compressing operation, the pressure in each of the compression chambers 10 comes to a thrust load so as to act the orbiting scroll 7. The thrust load is supported by using three auxiliary crank mechanisms 11.

Accordingly, a centrifugal force acts on the orbiting scroll 7 in connection with the orbiting motion of the orbiting scroll 7. The centrifugal force is sheared and supported by the orbiting bearing 31 and the auxiliary crank mechanism 11. At this time, the centrifugal force acts on the main balance weight 35. Further, the centrifugal force of the main balance weight 35 is changed in correspondence to a support load of the main bearing 33, and the centrifugal force of the orbiting scroll 7 acting on the auxiliary crank mechanism 11 is changed in connection therewith.

Accordingly, the applicant makes a study of a relation between the internal gap δa of the orbiting bearing 31 and the internal gap δb of the main bearing 33, and the load caused by the centrifugal force given to the auxiliary crank mechanism 11.

Figure 8:
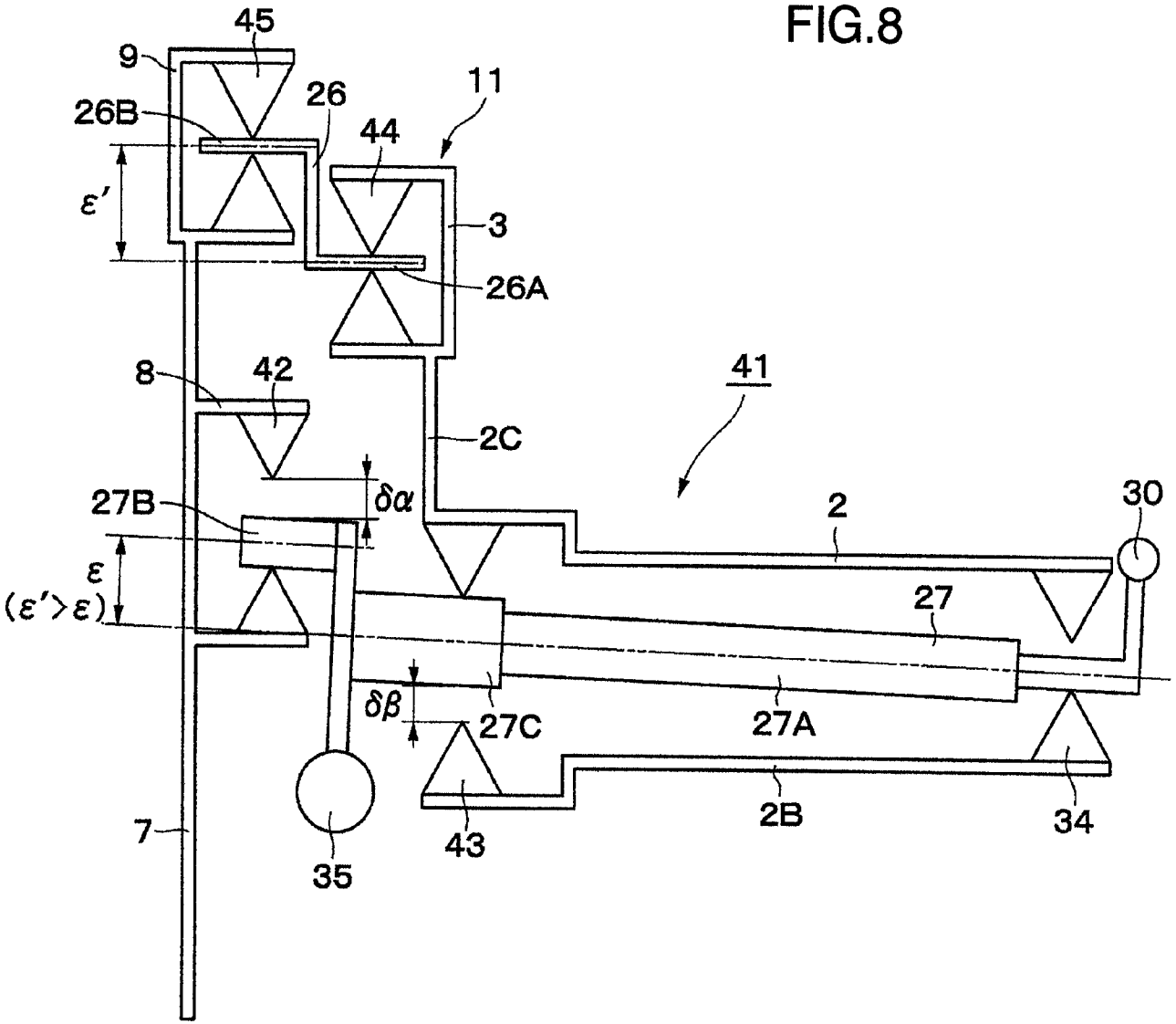
FIG. 8 is a schematic explanatory view showing a stop state of a scroll type air compressor in accordance with a first comparative example.
Figure 9:
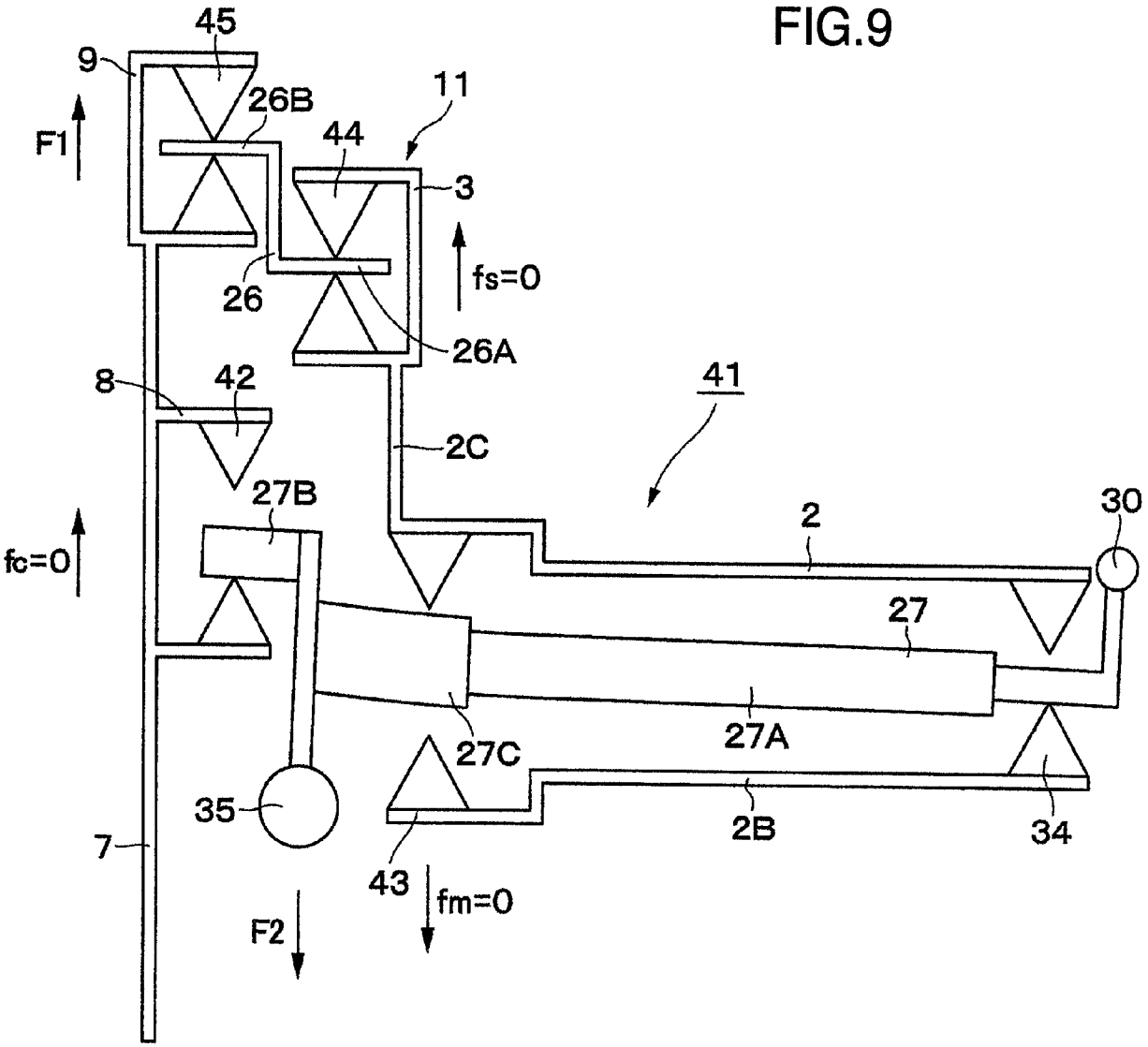
FIG. 9 is a schematic explanatory view showing a transient state just after the scroll type air compressor in accordance with the first comparative example starts.
Figure 10:
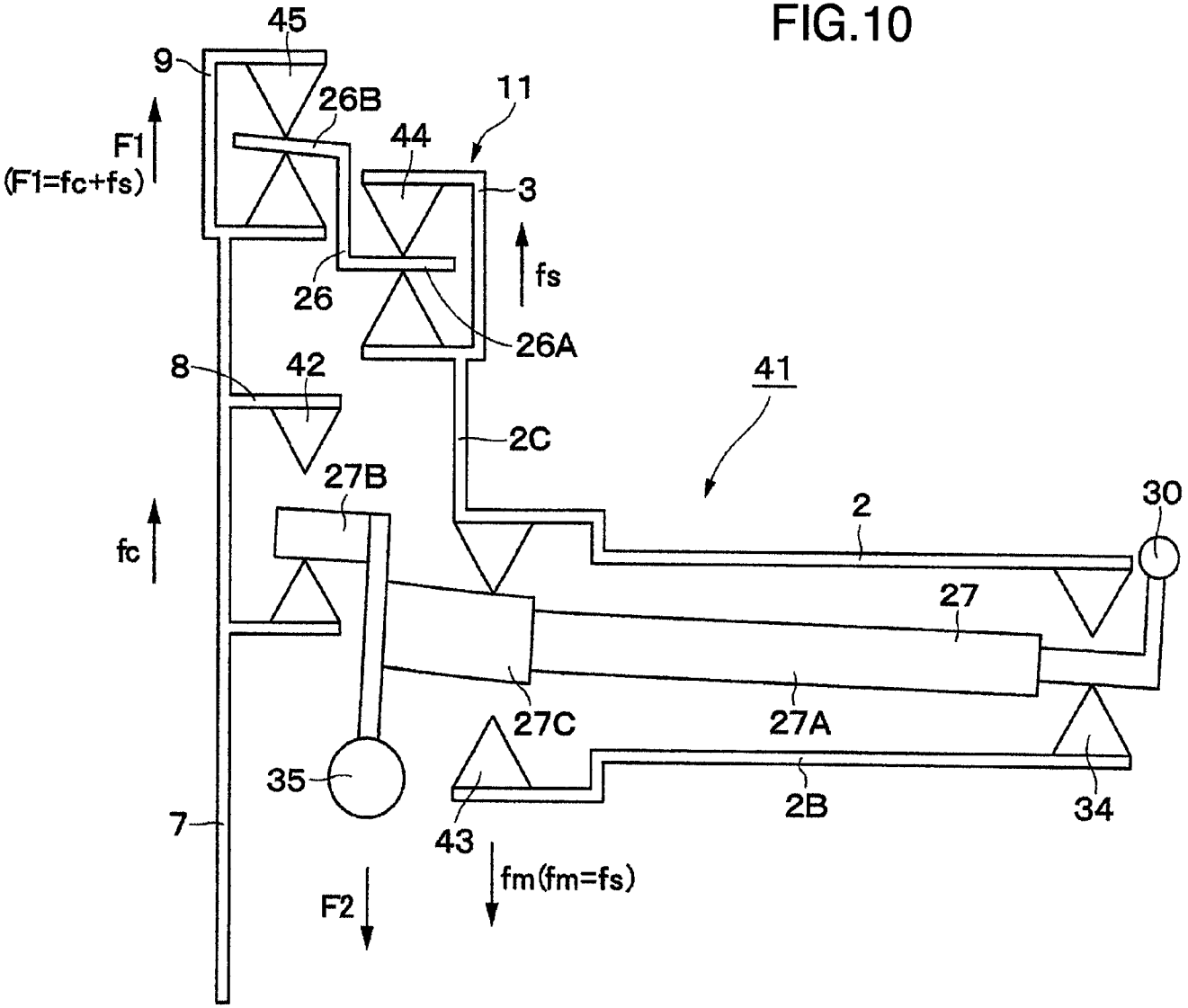
FIG. 10 is a schematic explanatory view showing a steady state in which the scroll type air compressor in accordance with the first comparative example is driven at a steady rotating speed.

First of all, the applicant makes a study of a case that the internal gap δb of the main bearing 43 is smaller than the value obtained by subtracting the double value of the eccentric amount difference As from the internal gap δa of the orbiting bearing 42, such as the compressor 41 in accordance with a first comparative example shown in FIGS. 8 to 10, that is, a case that the numerical expression 3 is not established. At this time, it is assumed that the eccentric amount ϵ' of the auxiliary crank shaft 26 is set to a value (ϵ'>ϵ) which is larger than the eccentric amount ϵ of the drive shaft 27.

In the compressor 41 under the stop state as shown in FIG. 8, since the eccentric amount ϵ' of the auxiliary crank shaft 26 is larger than the eccentric amount ϵ of the drive shaft 27, the internal gap δa of the orbiting bearing 42 comes to 0. Further, if the operation of the compressor 41 is started, the drive shaft 27 is rotationally driven, and the orbiting scroll 7 starts orbiting.

At this time, as shown in FIG. 9, the orbiting scroll 7 generates a load F1 heading for an outer side in the radial direction on the basis of the centrifugal force. On the other hand, the main balance weight 35 generates a load F2 caused by the centrifugal force, and the load F2 comes to an inverse direction to the load F1 caused by the centrifugal force of the orbiting scroll 7.

In this case, since the internal gap δb of the main bearing 43 is larger than 0 even in a transient state just after starting the operation shown in FIG. 9, the main bearing 43 is not exposed to the load F2 caused by the centrifugal force of the balance weight 35. Accordingly, a load fm received by the main bearing 43 comes to 0 (fm=0).

On the other hand, the orbiting bearing 42 can receive all the loads F1 caused by the centrifugal force of the orbiting scroll 7. Further, the orbiting bearing 42 also receives the load F2 caused by the centrifugal force of the balance weight 35. At this time, since two loads F1 and F2 cancel each other, a load fc received by the orbiting bearing 42 comes to 0 (fc=0). As a result, a load fs received by the auxiliary crank bearings 44 and 45 comes to 0 (fs=0), and the auxiliary crank bearings 44 and 45 are not exposed to the load F1 caused by the centrifugal force of the orbiting scroll 7.

However, if a rotating speed of the drive shaft 27 comes to rated rotating speed and the compressor 41 comes to a steady state, as shown in FIG. 10, the drive shaft 27 elastically deforms around the opposed load side bearing 34, for example, over about some tens to some hundreds n, in the crank pin 27B side. Accordingly, since the orbiting scroll 7 displaces toward an outer side in a radial direction on the basis of its centrifugal force, the auxiliary crank bearings 44 and 45 are exposed to the load F1 caused by the centrifugal force of the orbiting scroll 7 at this displacement. As mentioned above, since the load F1 caused by the centrifugal force of the orbiting scroll 7 is shared and supported by the orbiting bearing 42 and the auxiliary crank bearings 44 and 45, the load F1 can be expressed by a sum (F1=fc+fs) of the load fc received by the orbiting bearing 42 and the load fs received by the auxiliary crank bearings 44 and 45.

On the other hand, the internal gap δb of the main bearing 43 comes to 0 on the basis of the displacement of the orbiting scroll 7. Accordingly, the main bearing 43 receives a part of the load F2 caused by the centrifugal force of the balance weight 35 which is supposed to cancel the load fs of which the auxiliary crank bearings 44 and 45 have charge. At this time, the main bearing 43 is exposed to the remaining part obtained by canceling the load fc from the load F2, the load fm received by the main bearing 43 coincides the load fs received by the auxiliary crank bearings 44 and 45 (fm=fs).

As mentioned above, since the internal gap δb of the main bearing 43 comes to 0 in the steady state, the main bearing 43 bears a part of the load F2 caused by the centrifugal force of the main balance weight 35. Accordingly, since the auxiliary crank bearings 44 and 45 receive the load which should be originally received by the orbiting bearing 42, the auxiliary crank bearings 44 and 45 require a larger shape than the bearing which is necessary as the self-rotation preventing mechanism.

Particularly, in the case that the drive shaft 27 is rotated at a higher speed than the current product, for example, for increasing the discharge amount of the compressed air, a moving amount in a radial direction of the orbiting scroll 7 is increased due to the deformation of the main shaft 27. At this time, the load fs received by the auxiliary crank bearings 44 and 45 is increased in accordance that the load F1 caused by the centrifugal force of the orbiting scroll 7 is increased. Accordingly, the auxiliary crank bearings 44 and 45 are exposed to the greater load, and there is a problem that a reliability and a durability are lowered.

Next, the applicant makes a study of a case that the internal gap δb of the main bearing 33 is smaller than the value obtained by subtracting the twice value of the eccentric amount difference Δϵ from the internal gap δa of the orbiting bearing 31, that is, a case that the numerical expression 3 is established, such as the compressor 1 in accordance with the first embodiment. Even in this case, in the same manner as the first comparative example, it is assumed that the eccentric amount ϵ' of the auxiliary crank shaft 26 and the eccentric amount ϵ of the drive shaft 27 are different from each other, in the same manner as the first comparative example, and the eccentric amount ϵ' is set to the value (ϵ'>ϵ) which is larger than the eccentric amount ϵ.

Figure 6:
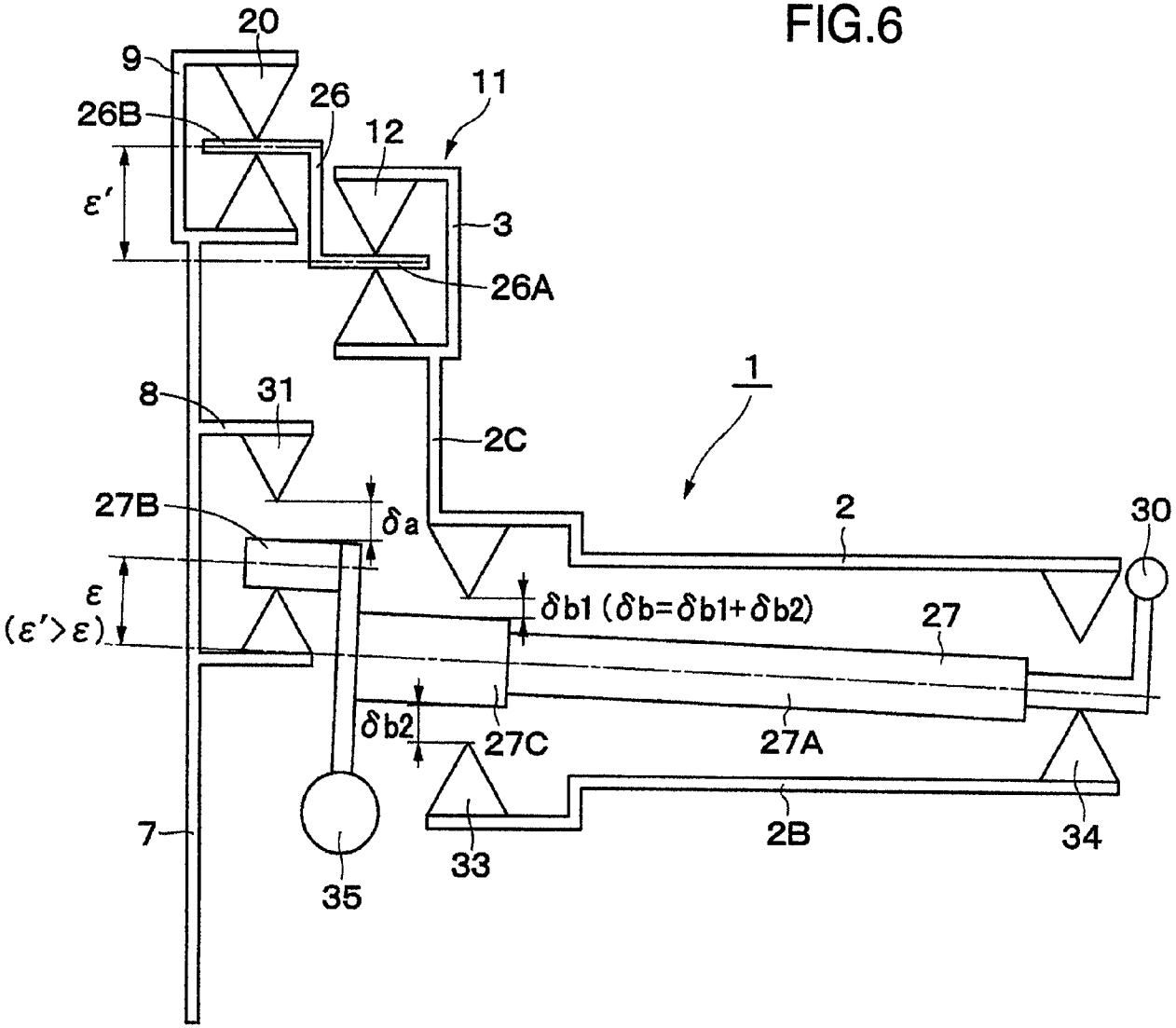
FIG. 6 is a schematic explanatory view showing a stop state of the scroll type air compressor in accordance with the first embodiment.

If the operation of the compressor 1 under a stop state as shown in FIG. 6 is started, the drive shaft 27 is rotationally driven, and the orbiting scroll 7 starts its orbiting motion. At this time, in the same manner as the first comparative example, the orbiting scroll 7 generates the load F1 heading for the outer side in the radial direction due to the centrifugal force, and the main balance weight 35 generates the load F2 in the inverse direction to the load F1 on the basis of the centrifugal force (refer to FIG. 7).

Figure 7:
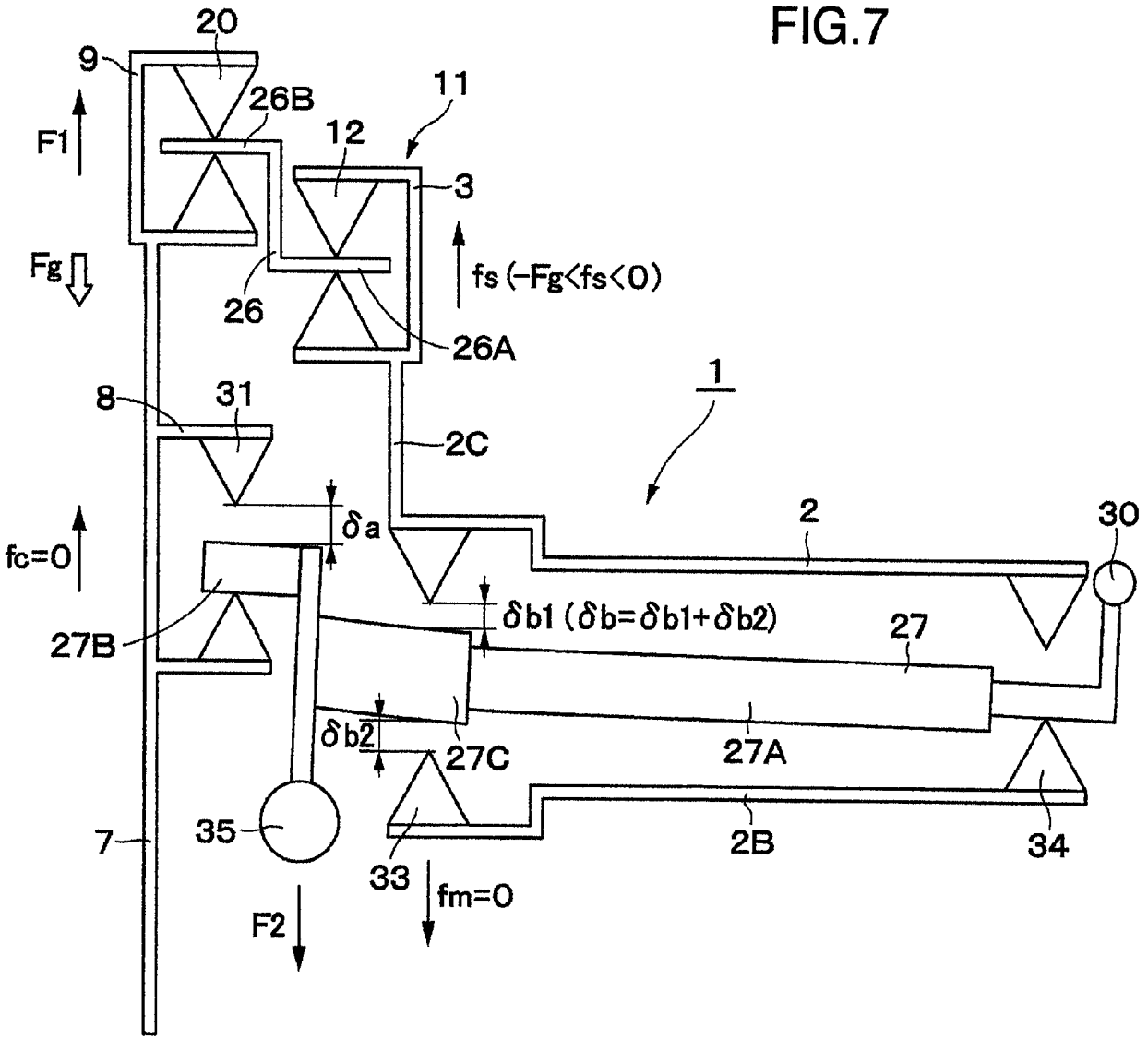
FIG. 7 is a schematic explanatory view showing a steady state in which the scroll type air compressor in accordance with the first embodiment is driven at a steady rotating speed.

Further, the drive shaft 27 is elastically deformed and the orbiting scroll 7 displaces toward the outer side in the radial direction on the basis of its centrifugal force in accordance with an increase of the rotating speed of the drive shaft 27. However, since the internal gap δb of the main bearing 33 is secured sufficiently large, the internal gap δ (the gaps δb1 and δb2) of the main bearing 33 does not come to 0 even if the compressor 1 comes to the steady state and the internal gap δa of the orbiting bearing 31 comes to 0, as shown in FIG. 7, which is different from the first comparative example.

At this time, the orbiting bearing 31 is exposed to the load F1 caused by the centrifugal force of the orbiting scroll 7, and is exposed to the load F2 caused by the centrifugal force of the main balance weight 35. Accordingly, since these two loads F1 and F2 are canceled with each other, the load fc received by the orbiting bearing 31 comes to 0 (fc=0).

Further, since the internal gap δb of the main bearing 33 does not come to 0, the main bearing 33 is not exposed to the load F2 caused by the centrifugal force of the main balance weight. Accordingly, the load fm received by the main bearing 33 comes to 0 (fm=0).

Further, since the load F1 caused by the centrifugal force of the orbiting scroll 7 is canceled by the load F2 caused by the centrifugal force of the main balance weight 35, the auxiliary crank bearings 12 and 20 are not exposed to the load F1 caused by the centrifugal force of the orbiting scroll 7. Accordingly, the load fs received by the auxiliary crank bearings 12 and 20 comes to 0 (fs=0), and it is possible to improve a reliability and a durability of the auxiliary crank bearings 12 and 20. Further, since the auxiliary crank bearings 12 and 20 are sufficiently constructed by the bearing which is necessary as the self-rotation preventing mechanism, the compressor 1 is not enlarged in size even in the case of rotating the drive shaft 27 at a high speed.

Next, the applicant carries out a simulation analysis of a relation between the internal gap δb of the main bearing 33 and the load Fs received by the auxiliary crank bearings 12 and 20 by using a finite element method. At this time, the discharge pressure of the compressor 1 is set to 0.85 Pa, and the eccentric amount ϵ of the drive shaft 27 is set to 5.77 mm. Results will be shown in FIG. 11.

Figure 11:
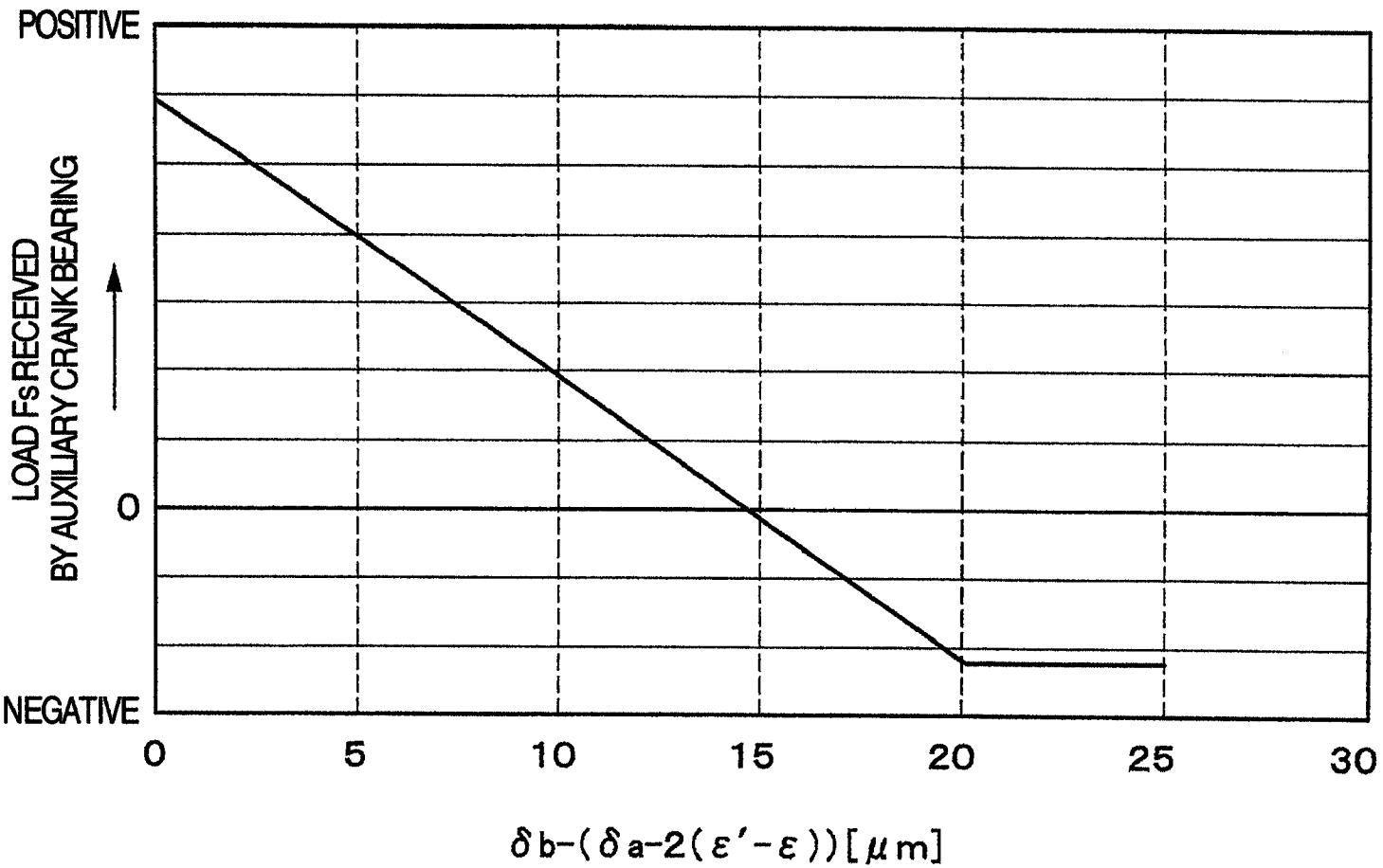
FIG. 11 is a characteristic graph showing a relation between a value obtained by subtracting a reference value from an internal gap of a main bearing and a load acting on an auxiliary crank bearing.

As shown in the results in FIG. 11, it the internal gap δb of the main bearing 33 is 15 μm larger than the reference value δ0 in the case of setting the value obtained by subtracting the double value of the eccentric amount difference Δϵ from the internal gap δa of the orbiting bearing 31, it is known that the auxiliary crank bearings 12 and 20 are not exposed to the load F1 caused by the centrifugal force of the orbiting scroll 7. Accordingly, it is preferable that the internal gap δb of the main bearing 33 is set 15 μm larger than the reference value δ0, as shown by numerical expression 4.

$$\delta b-(\delta a-2\times(\epsilon'-\epsilon))>15\ \mu m$$

$$\delta b-(\delta a-2\times\Delta\epsilon)>15\ \mu m$$

$$\delta b-\delta 0>15\ \mu m \qquad \text{Numerical Expression 4}$$

In this case, in FIG. 11, the load in the inverse direction to the centrifugal force of the orbiting scroll 7 acts on the auxiliary crank bearings 12 and 20, in accordance that the internal gap δb of the main bearing 33 becomes 15 μm larger than the reference value δ0. This is because a gas load Fg is generated by the compressed air within the compression chamber 10.

In other words, when the compressor 1 is driven, the gas load Fg is generated by the compressed air within the compression chamber 10, and the gas load Fg is applied in the inverse direction to the load F1 caused by the centrifugal force of the orbiting scroll 7. Accordingly, the gas load Fg acts on the auxiliary crank bearings 12 and 20, the orbiting bearing 31 and the main bearing 33, even in the compressor 1 in accordance with the first embodiment. However, the gas load Fg is approximately a constant value without depending on the rotating speed of the drive shaft 27.

Therefore, as shown in FIG. 11, the load fs received by the auxiliary crank bearings 12 and 20 is saturated at a time when the internal gap δb of the main bearing 33 becomes, for example, 20 μm larger than the reference value δ0.

Further, the gas load Fg is smaller then the load F1 caused by the centrifugal force. Accordingly, it is possible to design the auxiliary crank bearings 12 and 20 while previously taking the gas load Fg into consideration, and there is no risk that the reliability of the auxiliary crank bearings 12 and 20 is lowered by the gas load Fg.

Accordingly, in accordance with the present embodiment, if the orbiting scroll 7 is rotated in the steady state, the orbiting scroll 7 is moved in the radial direction by the centrifugal force, and the internal gap δa of the orbiting bearing 31 which forms the diametrical gap of the crank pin 27B comes to 0. At this time, the orbiting bearing 31 is exposed to the load F1 caused by the centrifugal force of the orbiting scroll 7.

On the other hand, since the internal gap δb of the main bearing 33 which forms the diametrical gap of the main shaft portion 27A is set in such a manner as to satisfy the numerical expression 3, the internal gap δb of the main bearing 33 does not come to 0 even if the internal gap δa of the orbiting bearing 31 comes to 0. As a result, the main bearing 33 is not exposed to the load F2 caused by the centrifugal force of the balance weight 35.

At this time, since the orbiting bearing 31 can receive all the load F1 caused by the centrifugal force of the orbiting scroll 7, the load F1 caused by the centrifugal force of the orbiting scroll 7 balances the load F2 caused by the centrifugal force of the balance weight 35. Accordingly, since two loads F1 and F2 are canceled by each other, the first and second auxiliary crank bearings 12 and 20 are not exposed to the load F1 caused by the centrifugal force of the orbiting scroll 7. As a result, it is possible to increase the reliability and the durability of the auxiliary crank bearings 12 and 20, and it is possible to increase the discharge amount of the compressed air by increasing the rotating speed of the drive shaft 27 without enlarging the size of the auxiliary crank bearings 12 and 20.

Particularly, in the case that the internal gap δb of the main bearing 33 is set in a range satisfying the numerical expression 4, the internal gap δb of the main bearing 33 does not come to 0 even if the drive shaft 27 is elastically deformed by the centrifugal force of the orbiting scroll 7 at a time when the orbiting scroll 7 rotates in the steady state. As a result, since the main bearing 33 is not exposed to the load F2 caused by the centrifugal force of the balance weight 35, it is possible to securely cancel the centrifugal force of the orbiting scroll 7 on the basis of the centrifugal force of the balance weight 35. Accordingly, since the auxiliary crank bearings 12 and 20 are not exposed to the load F1 caused by the centrifugal force of the orbiting scroll 7, it is possible to securely improve the reliability or the like of the auxiliary crank bearings 12 and 20.

Further, since the internal gap δb of the main bearing 33 does not come to 0 at a time when the drive shaft 27 comes to the steady rotating speed, the leading end side of the drive shaft 27 is supported by the auxiliary crank mechanism 11 via the orbiting bearing 31 and the orbiting scroll 7, and the base end side of the drive shaft 27 is supported by the opposed load side bearing 34. Accordingly, since the drive shaft 27 is supported at two positions, the drive shaft 27 can be statically supported.

In addition, since the crank pin 27B positioned at the leading end of the drive shaft 27 can displace in the eccentric direction, the orbiting scroll 7 is supported at three positions by the auxiliary crank mechanism 11. Accordingly, it is possible to reduce from a four-point statically indeterminate to a three-point statically indeterminate in comparison with the case that the crank pin 27B can not displace in the radial direction. Accordingly, it is possible to suppress a statically indeterminate load caused by a position error, a thermal expansion or the like, and it is possible to prevent the bearings 12, 13, 31, 33 and 34 from being damaged.

Further, since the orbiting bearing 31 is formed by using the cylindrical roller bearing, it is possible to regulate the diametrical gap of the crank pin 27B of the drive shaft 27 by using the internal gap δa generated between the outer lace 31A and the inner lace 31B, and the roller 31C. Further, it is possible to assemble the inner lace 31B in a state of being attached to the crank pin 27B after assembling the outer lace 31A and the roller 31C in the orbiting scroll 7, and it is possible to increase an assembling characteristic, for example, in comparison with a case using a ball bearing.

Further, since the main bearing 33 is formed by using the deep groove ball bearing, it is possible to regulate the diametrical gap of the main shaft portion 27A of the drive shaft 27 by using the internal gap δb generated between the outer lace 33A and the inner lace 33B, and the spherical body 33C.

Further, since the first and second auxiliary crank bearings 12 and 20 of the auxiliary crank mechanism 11 are formed by using the angular ball bearings 13, 14, 21 and 22, it is possible to pinch the steel balls 13C, 14C, 21C and 22C serving as the rolling element between the outer laces 13A, 14A, 21A and 22A and the inner laces 13B, 14B, 21B and 22B of the angular ball bearings 13, 14, 21 and 22 in the state in which the preload is given. Accordingly, the steel balls 13C, 14C, 21C and 22C can be securely brought into contact with the outer laces 13A, 14A, 21A and 22A and the inner laces 13B, 14B, 21B and 22B, and it is possible to minimize the internal gap of the auxiliary crank bearings 12 and 20. As a result, the orbiting scroll 7 does not displace in the radial direction by the internal gap of the auxiliary crank bearings 12 and 20, and it is possible to prevent the internal gap δb of the main bearing 33 from coming to 0.

In this case, in the first embodiment, it is assumed that the eccentric amount ε' of the auxiliary crank shaft 26 is set to the value (ε'>ε) which is larger than the eccentric amount ε of the drive shaft 27. However, the present invention is not limited to this, for example, the eccentric amount ε' of the auxiliary crank shaft 26 may be set to a value (ε<ε) which is smaller than the eccentric amount ε of the drive shaft 27.

Figure 12:
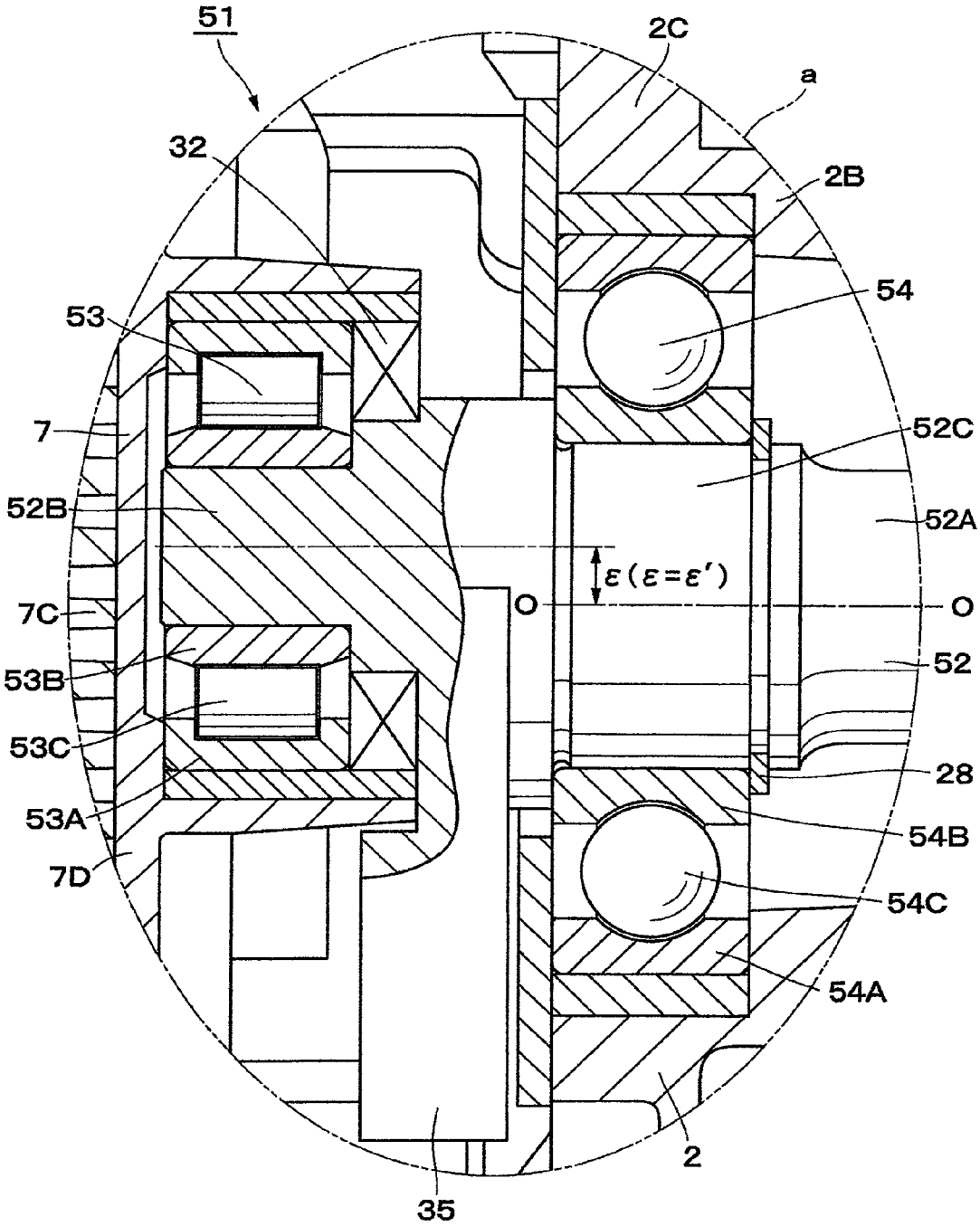
FIG. 12 is an enlarged vertical cross sectional view of a similar position to FIG. 2 and shows a scroll type air compressor in accordance with a second embodiment.
Figure 13:
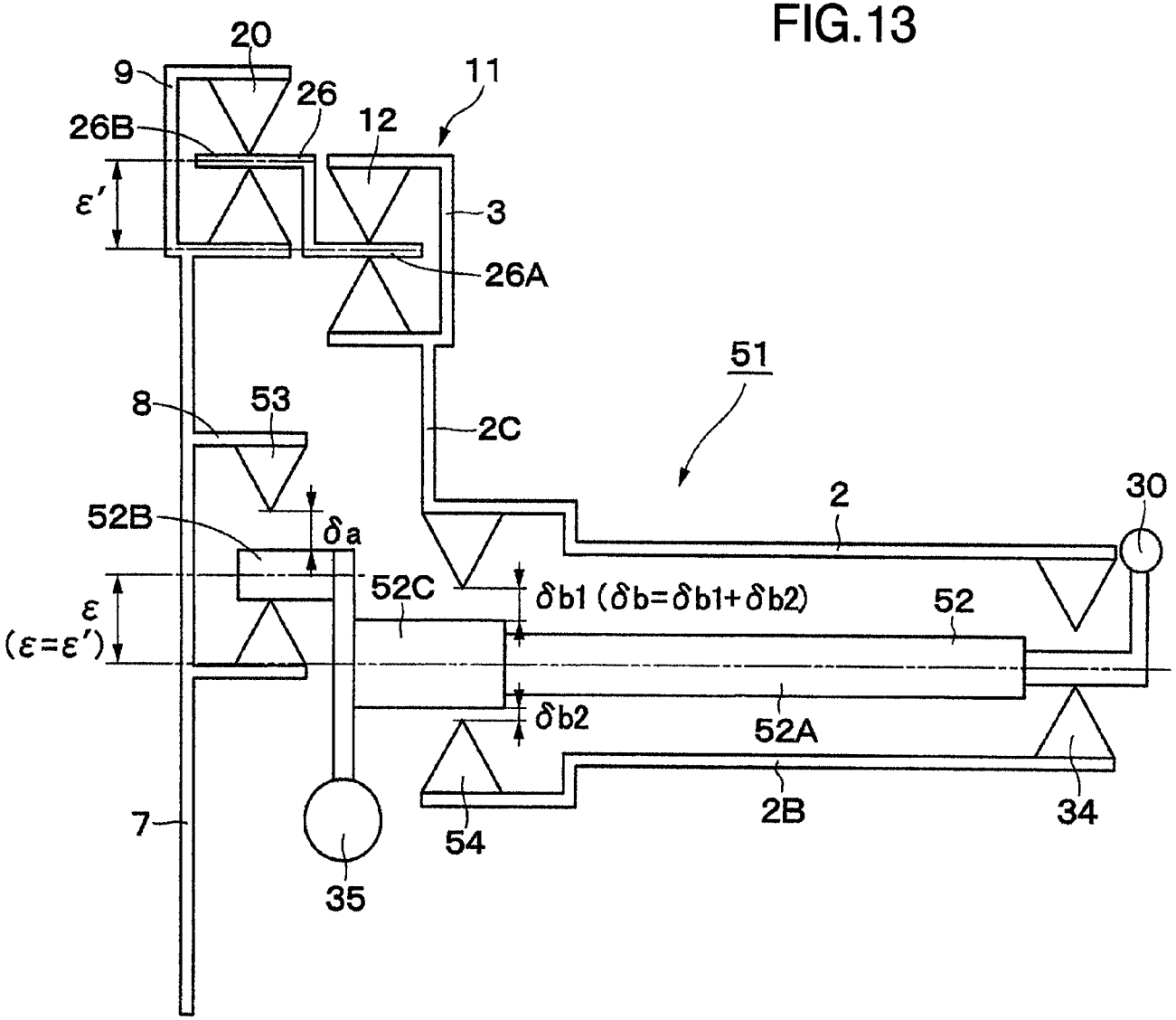
FIG. 13 is a schematic explanatory view showing a stop state of the scroll type air compressor in accordance with the second embodiment.
Figure 14:
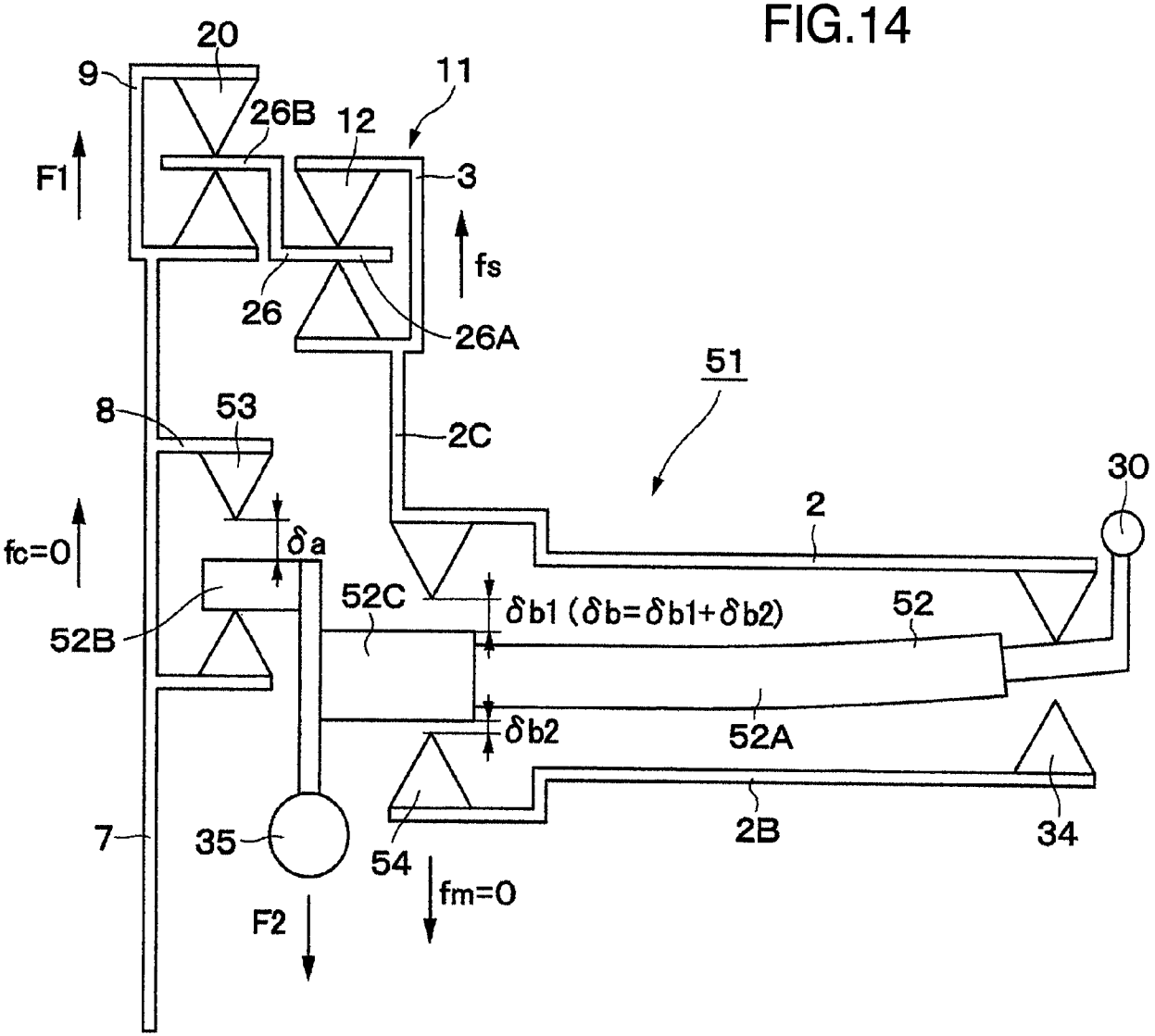
FIG. 14 is a schematic explanatory view showing a steady state in which the scroll type air compressor in accordance with the second embodiment is driven at a steady rotating speed.

Next, FIGS. 12 to 14 show a second embodiment in accordance with the present invention. The feature of the present embodiment is to set the eccentric amount of the drive shaft to the same value as the eccentric amount of the crank shaft, and to set the internal gap of the main bearing to the value which is larger than the internal gap of the orbiting bearing. In this case, in the second embodiment, the same reference numerals are attached to the same constructing elements as those of the first embodiment mentioned above, and a description thereof will be omitted.

A scroll type air compressor 51 in accordance with the second embodiment is constructed by a casing 2, a fixed scroll 4, a orbiting scroll 7, an auxiliary crank mechanism 11, a drive shaft 52, a orbiting bearing 53, a main bearing 54, a balance weight 35 and the like, in the same manner as the scroll type air compressor 1 in accordance with the first embodiment.

Reference numeral 52 denotes a drive shaft in accordance with the second embodiment. The drive shaft 52 is constructed by a main shaft portion 52A and a crank pin 52B approximately in the same manner as the drive shaft 27 in accordance with the first embodiment.

Further, the main balance weight 35 is attached to the drive shaft 52 so as to be positioned to a base end side of the crank pin 52B. Further, a bearing attaching portion 52C to which the main bearing 54 is attached is formed near of the main balance weight 35 in the drive shaft 52, so as to be positioned in an opposite side to the crank pin 52B while sandwiching the main balance weight 35 with respect to an axial direction. Further, an eccentric amount ε of the drive shaft 52 is set to the same value as the eccentric amount ε' of the auxiliary crank shaft 26 (ε=ε').

Reference numeral 53 denotes a orbiting bearing in accordance with the second embodiment. The orbiting bearing 53 is formed by using a cylindrical roller bearing constructed by an outer lace 53A, an inner lace 53B and rollers 53C, approximately in the same manner as the orbiting bearing 31 in accordance with the first embodiment. Further, the orbiting bearing 53 is provided in the boss portion 8 so as to be positioned in a back face side of the end plate 7A of the orbiting scroll 7. Further, the orbiting bearing 53 has an internal gap δa having a dimension, for example, about some tens μm.

Reference numeral 54 denotes a main bearing in accordance with the second embodiment. The main bearing 54 is formed by using a deep groove ball bearing constructed by an outer lace 54A, an inner lace 54B and spherical bodies 54C approximately in the same manner as the main bearing 33 in accordance with the first embodiment. Further, the main bearing 54 rotatably supports the bearing attaching portion 52C of the drive shaft 52 so as to be positioned in the other end side in an axial direction in the bearing tube portion 2B. Further, the main bearing 54 has an internal gap δb having a dimension, for example, about some tens μm. At this time, the internal gap δb of the main bearing 54 is set to a value which is larger than the internal gap δa of the orbiting bearing 53 as shown by the following numerical expression 5.

$$\delta b > \delta a \qquad \text{Numerical Expression 5}$$

The scroll type air compressor 1 in accordance with the second embodiment has the structure as mentioned above. Next, the applicant makes a study of a relation between the internal gap δa of the orbiting bearing 53 and the internal gap δb of the main bearing 54, and the load caused by the centrifugal force received by the auxiliary crank mechanism 11.

Figure 15:
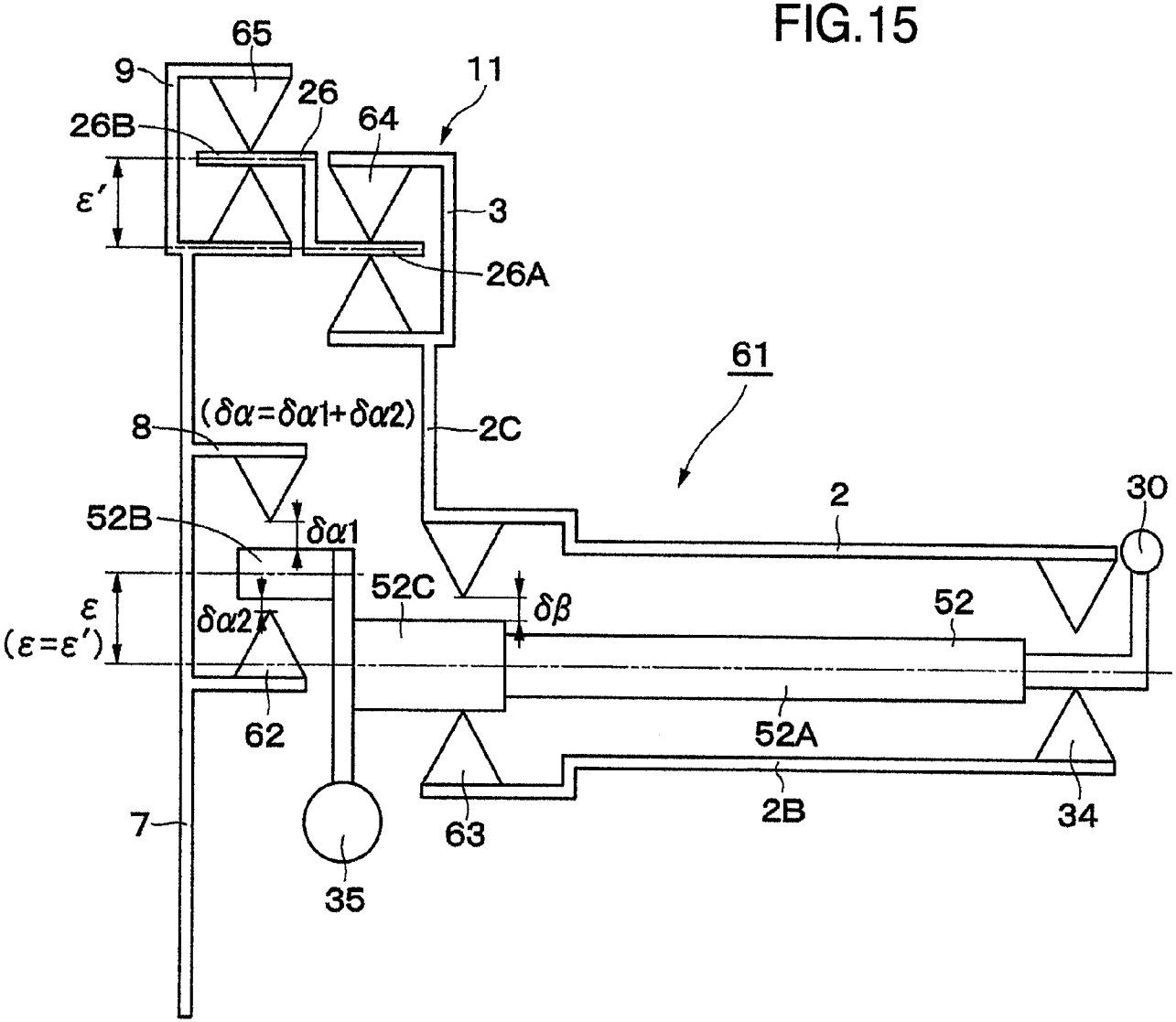
FIG. 15 is a schematic explanatory view showing a stop state of a scroll type air compressor in accordance with a second comparative example.
Figure 16:
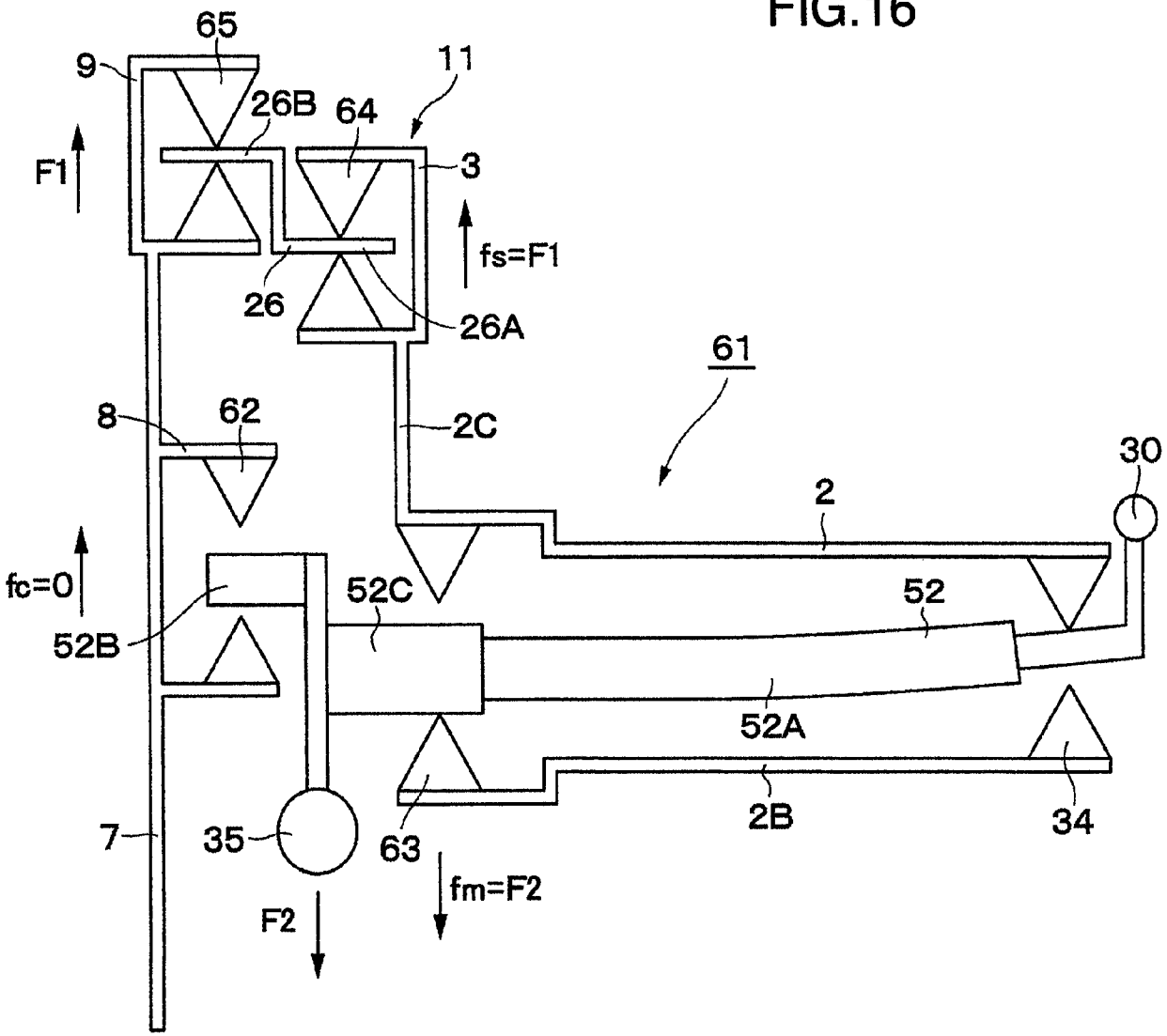
FIG. 16 is a schematic explanatory view showing a transient state just after the scroll type air compressor in accordance with the second comparative example starts.
Figure 17:
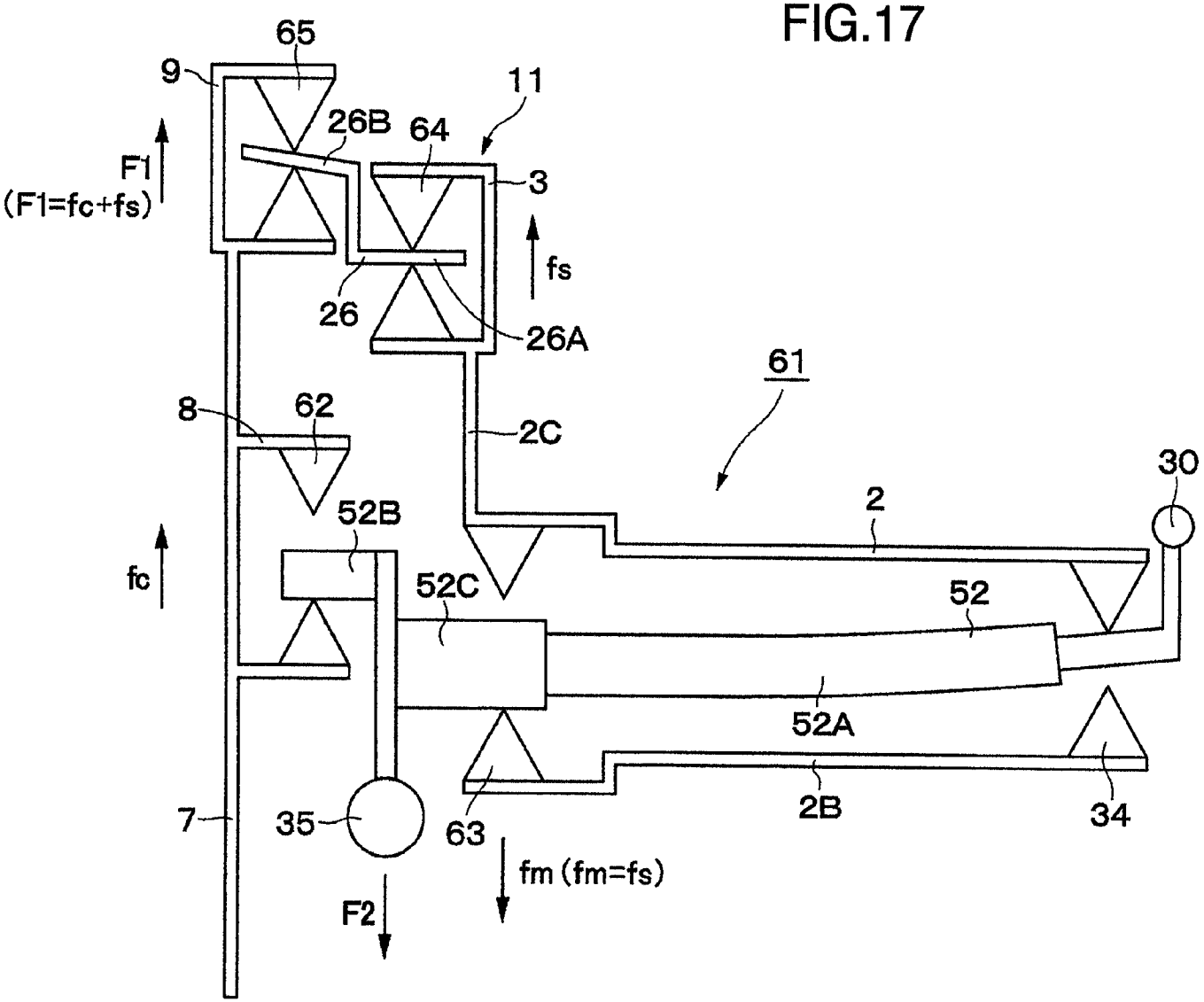
FIG. 17 is a schematic explanatory view showing a steady state in which the scroll type air compressor in accordance with the second comparative example is driven at a steady rotating speed.

First of all, the applicant makes a study of a case that an internal gap δa of a orbiting bearing 62 is larger than an internal gap δb of a main bearing 63 (δa>δb) such as a compressor 61 in accordance with a second comparative example shown in FIGS. 15 to 17. At this time, it is assumed that the eccentric amount ϵ of the drive shaft 52 is set to the same value as the eccentric amount ϵ' of the auxiliary crank shaft 26 (δ=ϵ').

If the operation of the compressor 61 in a stop state as shown in FIG. 15 is started, the drive shaft 52 is rotationally driven, and the orbiting scroll 7 starts its orbiting motion. At this time, as shown in FIG. 16, the orbiting scroll 7 generates a load F1 heading for an outer side in the radial direction on the basis of the centrifugal force. On the other hand, the main balance weight 35 generates a load F2 caused by the centrifugal force, and the load F2 comes to an inverse direction to the load F1 caused by the centrifugal force of the orbiting scroll 7.

In this case, in a transient state just after starting the operation shown in FIG. 16, the crank pin 52B comes to a state in which it has a degree of freedom with respect to the radial direction at the internal gap δa of the orbiting bearing 62. Accordingly, the centrifugal force generated by the orbiting scroll 7 is not acting on the drive shaft 52, but only the centrifugal force generated by the main balance weight 35 is applied thereto. Accordingly, the drive shaft 52 is inclined in the radial direction at the internal gap δb of the main bearing 63 around the opposed load side bearing 34, and the bearing attaching portion 52C of the main shaft portion 52A comes to a state in which it is pressed to the main balance weight 35 side of the main bearing 63. As a result, since the internal gap δb of the main bearing 63 comes to 0, the main bearing 63 is exposed to the load F2 caused by the centrifugal force of the main balance weight 35. At this time, the load fm received by the main bearing 63 coincides with the load F2 caused by the centrifugal force of the main balance weight 35 (fm=F2).

On the other hand, the auxiliary crank bearings 64 and 65 are exposed all the load F1 caused by the centrifugal force of the orbiting scroll 7. Accordingly, the load fs received by the auxiliary crank bearings 64 and 65 coincides with the load F1 caused by the centrifugal force of the orbiting scroll 7 (fs=F1). At this time, the load fc received by the orbiting bearing 62 comes to 0 (fc=0).

Further, if the rotating speed of the drive shaft 52 comes to a rated rotating speed, the compressor 61 comes to a steady state shown in FIG. 17. At this time, the orbiting scroll 7 displaces toward an outer side in a radial direction on the basis of its centrifugal force, and the internal gap δa of the orbiting bearing 62 comes to 0. Accordingly, the orbiting bearing 62 receives the load F1 caused by the centrifugal force of the orbiting scroll 7. Further, the auxiliary crank bearings 64 and 65 receives a corresponding load to the displacement of the internal gap δa of the orbiting bearing 62 in the load F1 caused by the centrifugal force of the orbiting scroll 7. As mentioned above, since the load F1 caused by the centrifugal force of the orbiting scroll 7 is shared and supported by the orbiting bearing 62 and the auxiliary crank bearings 64 and 65, the load F1 is expressed by a sum of a load fc received by the orbiting bearing 62 and a load fs received by the auxiliary crank bearings 64 and 65 (F1=fc+fs).

On the other hand, the main balance weight 35 functions only for the load fc received by the orbiting bearing 62. Accordingly, the load F2 caused by the centrifugal force of the main balance weight 35 cancels the load fc received by the orbiting bearing 62 by a part thereof. Further, the main bearing 63 bears a part of the load F2 caused by the centrifugal force of the main balance weight 35. At this time, since the main bearing 63 receives the remaining part obtained by canceling the load fc from the load F2, the load fm received by the main bearing 63 coincides with the load fs received by the auxiliary crank bearings 64 and 65 (fm=fs).

Generally, since the orbiting scroll 7 is attached to the drive shaft 52 after attaching the drive shaft 52 to the casing 2, the internal gap δa of the orbiting bearing 62 tends to be larger than the internal gap δb of the main bearing 63, such as the second comparative example. In this case, since the internal gap δb of the main bearing 63 does not come to 0 in the steady state, the main bearing 63 bears a part of the load F2 caused by the centrifugal force of the main balance weight 35. Accordingly, since the auxiliary crank bearings 64 and 65 receive the load which should be originally received by the orbiting bearing 62, the auxiliary crank bearings 64 and 65 require a larger shape than the bearing which is necessary as the self-rotation preventing mechanism.

Next, the applicant makes a study of a case that the internal gap δb of the main bearing 54 is larger than the internal gap δa of the orbiting bearing 53 (δb>δa) such as the compressor 51 in accordance with the second embodiment. Even in this case, it is assumed that the eccentric amount ϵ of the drive shaft 52 is set to the same value as the eccentric amount ϵ' of the auxiliary crank shaft 26 (ϵ=ϵ'), in the same manner as the second comparative example.

If the operation of the compressor 1 in a stop state as shown in FIG. 13 is started, the drive shaft 52 is rotatably driven, and the orbiting scroll 7 starts its orbiting motion. At this time, in the same manner as the first comparative example, the orbiting scroll 7 generates the load F1 heading for the outer side in the radial direction on the basis of the centrifugal force, and the main balance weight 35 generates the load F2 in the inverse direction to the load F1 on the basis of the centrifugal force.

Further, in connection with the increase of the rotating speed of the drive shaft 52, the orbiting scroll 7 displaces toward the outer side in the radial direction on the basis of its centrifugal force, and the internal gap δa of the orbiting bearing 53 comes to 0. However, since the internal gap δb of the main bearing 54 is larger than the internal gap δa of the orbiting bearing 53, the internal gap δb (the gaps δb1 and δb2) of the main bearing 54 does not come to 0 even if the rotating speed of the drive shaft 52 comes to a rated rotating speed, as shown in FIG. 14.

At this time, the orbiting bearing 53 is exposed to the load F1 caused by the centrifugal force of the orbiting scroll 7, and is exposed to the load F2 caused by the centrifugal force of the main balance weight 35. Accordingly, since these two loads F1 and F2 are canceled by each other, the load fc received by the orbiting bearing 53 comes to 0 (fc=0). Further, since the internal gap δb of the main bearing 54 does not come to 0, the main bearing 54 is not exposed to the load F2 caused by the centrifugal force of the main balance weight 35. Accordingly, the load fm received by the main bearing 54 comes to 0 (fm=0).

Further, since the load F1 caused by the centrifugal force of the orbiting scroll 7 is canceled by the load F2 caused by the centrifugal force of the main balance weight 35, the auxiliary crank bearings 12 and 20 are not exposed to the load F1 caused by the centrifugal force of the orbiting scroll 7. Accordingly, the load fs received by the auxiliary crank bearings 12 and 20 comes to 0 (fs=0), and it is possible to improve a reliability and a durability of the auxiliary crank bearings 12 and 20. Further, since the auxiliary crank bearings 12 and 20 are sufficiently constructed by the bearing which is necessary as the self-rotation preventing mechanism, the compressor 1 is not enlarged in size even in the case of rotating the drive shaft 52 at a high speed.

Accordingly, even in the second embodiment which is constructed as mentioned above, it is possible to obtain approximately similar operations and effects to the first embodiment.

Figure 18:
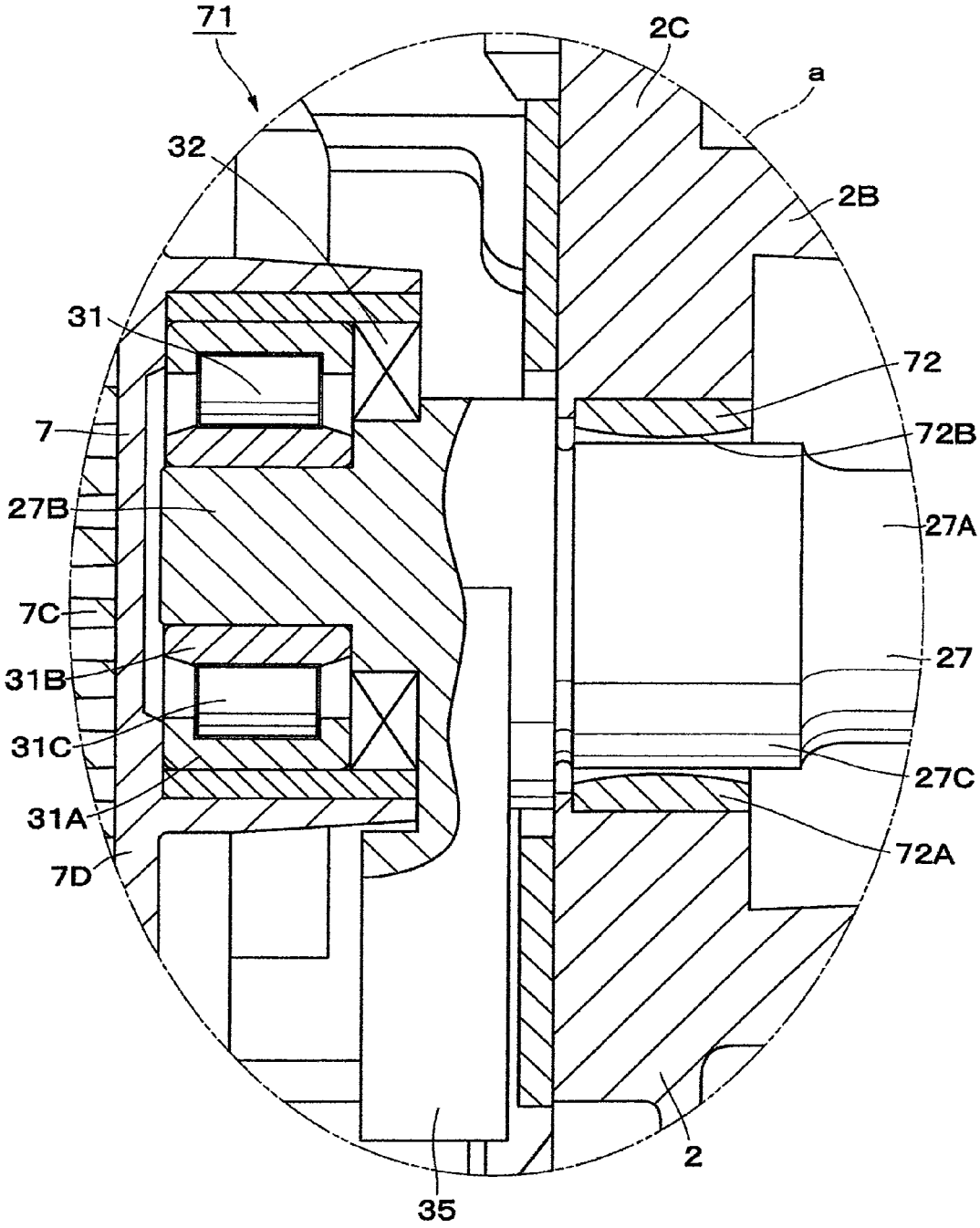
FIG. 18 is an enlarged vertical cross sectional view of a similar position to FIG. 2 and shows a scroll type air compressor in accordance with a third embodiment.
Figure 19:
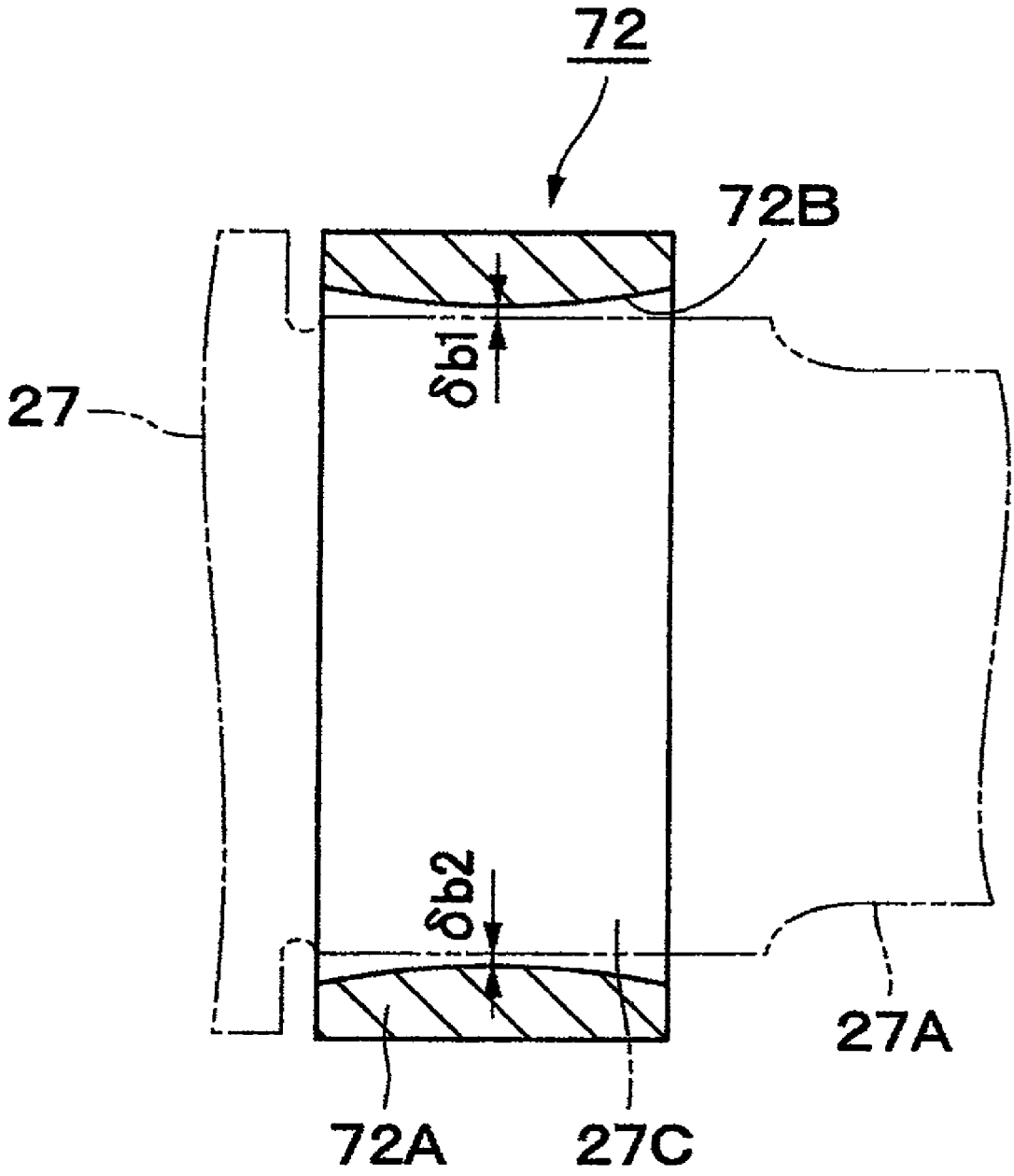
FIG. 19 is a cross sectional view showing a main bearing in FIG. 18 by a simple substance.

Next, FIGS. 18 and 19 shows a third embodiment in accordance with the present invention. A characteristic of the present embodiment exists in a point that the main bearing is formed by using a slide bearing. In this case, in the third embodiment, the same reference numerals are attached to the same constructing elements as those of the first embodiment, and a description thereof will be omitted.

A scroll type air compressor 71 in accordance with the third embodiment is constructed by a casing 2, a fixed scroll 4, a orbiting scroll 7, an auxiliary crank mechanism 11, a drive shaft 27, a orbiting bearing 31, a main bearing 72, a balance weight 35 and the like, approximately in the same manner as the scroll type air compressor 1 in accordance with the first embodiment.

Reference numeral 72 denotes a main bearing in accordance with the second embodiment. The main bearing 72 is formed by using a slide bearing (a sleeve bearing), for example, constructed by a cylindrical tube member 72A. Further, the tube member 72A is formed by using a material having a self-lubricating characteristic, for example, a metal material such as a copper or the like or a resin material such as a tetrafluoroethylene or the like, and constructs a dry bearing. Further, an inner peripheral side of the tube member 72A protrudes as a circular arc toward the drive shaft 27, and an inner peripheral surface of the tube member 72A forms a convex curved surface 72B protruding toward an inner side in a radial direction.

Further, the main bearing 72 is positioned at the other end side in the axial direction in the bearing tube portion 2B so as to rotatably support the bearing attaching portion 27C of the drive shaft 27. Further, the main bearing 72 has an internal gap δb, for example, about some tens μm. At this time, a dimension of the internal gap δb comes to a value obtained by adding two bearing gaps δb1 and δb2 formed between the main shaft portion 27A (the bearing attaching portion 27C) and the inner peripheral surface of the main bearing 72, as shown by the following numerical expression 6. Further, the internal gap δb of the main bearing 72 is set, for example, in such a manner as to satisfy the relation shown by the numerical expression 3 or 4.

$$\delta b=\delta b1+\delta b2 \qquad \text{Numerical Expression 6}$$

Accordingly, even in the third embodiment constructed as mentioned above, it is possible to obtain approximately similar operations and effects to those of the first embodiment. Particularly, since the main bearing 72 is formed by using the slide bearing constructed by a single tube member in the third embodiment, it is a simple structure in comparison with the case of using the ball bearing or the roller bearing, and it is possible to lower a manufacturing cost.

Further, since the inner peripheral surface of the main bearing 72 is formed as the convex curved surface 72A which protrudes toward the inner side in the radial direction, the inner peripheral surface of the main bearing 72 comes into contact with the outer peripheral surface of the main shaft portion 27A at one position in the axial direction. Accordingly, since the main bearing 72 can support the drive shaft 27 in a point contact state, it is possible to allow an inclination of the drive shaft 27, for example, even at a time when the drive shaft 27 is inclined around the opposed load side bearing 34.

In this case, the third embodiment is structured such that the main bearing 72 constructed by the slide bearing acts on the first embodiment, however, may be structured such that the main bearing constructed by the slide bearing is used in the second embodiment. In this case, the internal gap δb of the slide bearing may be set, for example, in such a manner as to satisfy the relation shown by the numerical expression 5.

Further, in each of the embodiments mentioned above, the auxiliary crank bearings 12 and 20 are constructed by using the angular ball bearings 13, 14, 21 and 22, for receiving the loads in two directions including the axial direction and the radial direction. Accordingly, the auxiliary crank bearings 12 and 20 have both the functions of being exposed to the load in the axial direction (the thrust direction) caused by the gas force within the compression chamber 10, and preventing the self-rotation of the orbiting scroll 7.

However, the present invention is not limited to this, but may be structured such that the auxiliary crank bearing is constructed by the bearing receiving only the radial load, and employs the deep groove ball bearing, the slide bearing or the like, if a mechanism bearing the axial load, for example, the thrust bearing or the like is independently provided.

In the case that the auxiliary crank bearings 12 and 20 are constructed by using the angular ball bearings 13, 14, 21 and 22, the bearing gap of the auxiliary crank bearings 12 and 20 comes to approximately 0. On the contrary, in the case that the auxiliary crank bearing employs the other bearings than the angular bearing, for example, the deep groove ball bearing, the roller bearing or the like, the bearing gap (the internal gap δd) is generated. In this case, it is necessary for the internal gap δb of the main bearing to take into consideration the internal gap δd of the auxiliary crank bearing, and it is necessary to satisfy the following numerical expression 7 in place of the numerical expression 3. At this time, the internal gap δd comes to a value (δd=δd1+δd2) obtained by adding the internal gap δd1 of the first auxiliary crank bearing and the internal gap δd2 of the second auxiliary crank bearing. In the same manner, it is necessary to satisfy the following numerical expression 8 in place of the numerical expression 4.

$$\delta b>(\delta a-2\times(\epsilon'+\delta d-\epsilon))$$

$$\delta b>(\delta a-2\times(\Delta\epsilon+\delta d)) \qquad \text{Numerical Expression 7}$$

$$\delta b-(\delta a-2\times(\epsilon'+\delta d-\epsilon))>15\ \mu m$$

$$\delta b-(\delta a-2\times(\Delta\epsilon+\delta d))>15\ \mu m \qquad \text{Numerical Expression 8}$$

Further, in each of the embodiments mentioned above, the first auxiliary crank bearing 12 of the auxiliary crank mechanism 11 is structured such as to be attached to the casing 2, however, may be structured such as to be attached to the fixed scroll 4.

Further, in each of the embodiments mentioned above, the orbiting bearings 31 and 53 are formed by using the roller bearing, and the main bearings 33 and 54 are formed by using the deep groove ball bearing. However, the present invention is not limited to this, but the orbiting bearing may be formed by using the deep groove ball bearing, and the main bearing may be formed by using the roller bearing. Further, both the orbiting bearing and the main bearing may be formed by using the deep groove ball bearing or the roller bearing. In other words, the orbiting bearing and the main bearing may be constructed by a bearing which can receive the load in the radial direction, and is provided with sufficient strength and durability with respect to the received load.

Each of the embodiments mentioned above is structured such that the closed-end tubular boss portion 8 is formed in the back face plate 7D which is provided in the back face of the end plate 7A of the orbiting scroll 7, the orbiting bearings 31 and 53 are provided in the boss portion 8, and the crank pins 27B and 52B serving as the eccentric shaft portion formed in the leading end side of the drive shafts 27 and 52 are rotatably coupled to the orbiting bearings 31 and 53. However, the present invention is not limited to this, but may be structured, for example, such that a coupling pin is provided in the back face plate 7D provided in the back face of the end plate 7A of the orbiting scroll 7, a closed-end tubular boss portion serving as an eccentric shaft portion which is eccentric from the main shaft portions 27A and 52A is formed in the leading end portions of the drive shafts 27 and 52, the orbiting bearing is provided in the boss portion, and the boss portion and the coupling pin are rotatably coupled.

Further, each of the embodiments mentioned above is described by exemplifying the scroll type air compressor 1 as the scroll type fluid machine. However, the present invention is not limited to this, but may act the other scroll type fluid machine including a refrigerant compressor compressing the refrigerant, a vacuum pump, an expansion machine and the like.

As mentioned in each of the embodiments mentioned above, in accordance with the invention of claim 1, the orbiting scroll moves in the radial direction on the basis of the centrifugal force, at a time when the orbiting scroll rotates in the steady state, and the diametrical gap ($\delta a$) of the orbiting bearing comes to 0. At this time, the orbiting bearing receives the load caused by the centrifugal force of the orbiting scroll.

On the other hand, since the diametrical gap ($\delta b$) of the main bearing is structured such as to be larger than the diametrical gap ($\delta a$) of the orbiting bearing, the diametrical gap ($\delta b$) of the main bearing becomes larger than 0 even if the diametrical gap ($\delta a$) of the orbiting bearing comes to 0. As a result, the main bearing does not receive the load caused by the centrifugal force of the balance weight. At this time, since the orbiting bearing can receive all the loads caused by the centrifugal force of the orbiting scroll, the load caused by the centrifugal force of the orbiting scroll balances the load caused by the centrifugal force of the balance weight. Accordingly, the first and second auxiliary crank bearings are not exposed to the load caused by the centrifugal force.

In accordance with the inventions of claims 2, 10 and 17, since at least one of the main bearing and the orbiting bearing is formed by using the ball bearing, it is possible to regulate the diametrical gap ($\delta b$) of the main shaft portion and the diametrical gap ($\delta a$) of the eccentric shaft portion by using the internal gap generated between the inner lace and the outer lace of the ball bearing, and the spherical bodies.

In this case, the orbiting bearing may be structured such as to be provided in the back face side of the end plate of the orbiting scroll, such as the inventions in accordance with claims 3, 11 and 18. In the case of structuring as mentioned above, it is possible to simplify the structure of the orbiting scroll. Further, since the wrap portion can be formed in a whole of the surface of the end plate, it is possible to enlarge a volume ratio of compression. Further, since the orbiting bearing can be arranged so as to protrude from the end plate to the back face side, it is possible to efficiently cool the orbiting bearing.

In accordance with the invention of claims 4, 12 and 19, since any one of the main bearing and the orbiting bearing is formed by using the roller bearing, it is possible to regulate the diametrical gap ($\delta b$) of the main bearing and the diametrical gap ($\delta a$) of the orbiting bearing by using the internal gap generated between the inner lace and the outer lace of the roller bearing, and the roller. Further, it is possible to assemble the inner lace after assembling the outer lace and the rollers, and it is possible to enhance an assembling characteristic in comparison with the ball bearing.

In this case, the orbiting bearing may be structured such as to be provided in the back face side of the end plate of the orbiting scroll, such as the inventions in accordance with claims 5, 13 and 20. In the case of the structure mentioned above, it is possible to simplify the structure of the orbiting scroll. Further, since the wrap portion can be formed in a whole of the front face of the end plate, it is possible to enlarge the volume ratio of the compression. Further, since the orbiting bearing can be arranged so as to protrude from the end plate to the back face side, it is possible to efficiently cool the orbiting bearing.

In accordance with the inventions of claims 6, 14 and 21, since the main bearing is formed by using the slide bearing, it is possible to simplify the structure in comparison with the case that the ball bearing or the roller bearing is used, and it is possible to save a manufacturing cost.

In accordance with the invention of claims 7, 15 and 22, since the inner peripheral surface of the slide bearing is formed as the convex curved surface protruding toward the inner side in the radial direction, the main bearing and the drive shaft come into contact with each other in a point contact state. Accordingly, for example, even in the case that the drive shaft is inclined by the centrifugal force of the orbiting scroll, the main bearing can allow the inclination.

In accordance with the invention of claim 8, the diametrical gap ($\delta b$) of the main bearing is structured such as to be larger than the difference between the diametrical gap ($\delta a$) of the orbiting bearing and the eccentric amount difference ($\Delta\epsilon$) between the eccentric amount ($\epsilon'$) of the auxiliary crank and the eccentric amount ($\epsilon$) of the drive shaft. Accordingly, even in the case that the diametrical gap ($\delta a$) of the orbiting bearing comes to 0 on the basis of the steady rotation of the orbiting scroll, the diametrical gap ($\delta b$) of the main bearing does not come to 0.

At this time, the main bearing is not exposed to the load caused by the centrifugal force of the balance weight. On the other hand, since the orbiting bearing can receive all the loads caused by the centrifugal force of the orbiting scroll, the load caused by the centrifugal force of the orbiting scroll balances the load caused by the centrifugal force of the balance weight. Accordingly, the first and second auxiliary crank bearings are not exposed to the load caused by the centrifugal force.

In accordance with the invention of claim 9, since the first and second auxiliary crank bearings of the auxiliary crank mechanism are formed by using the angular bearing, the rolling elements can be pinched between the inner lace and the outer lace of the angular bearing in the state in which the preload is given. Accordingly, the rolling elements can be securely brought into contact with the inner lace and the outer lace, and it is possible to minimize the internal gap of the auxiliary crank bearing.

In accordance with the invention of claim 16, the diametrical gap (δb) of the main bearing is structured such as to be 15 μm or more larger than the difference (the reference value δ0) between the diametrical gap (δa) of the orbiting bearing and the eccentric amount difference (Δϵ) between the eccentric amount (ϵ') of the auxiliary crank and the eccentric amount (ϵ) of the drive shaft. Accordingly, the diametrical gap (δb) of the main bearing does not come to 0 even in the case that the drive shaft elastically deforms on the basis of the centrifugal force of the orbiting scroll at a time when the orbiting scroll rotates in the steady state. As a result, since the main bearing is not exposed to the load caused by the centrifugal force of the balance weight, it is possible to securely cancel the centrifugal force of the orbiting scroll by the centrifugal force of the balance weight. Accordingly, the first and second auxiliary crank bearings are not exposed to the load caused by the centrifugal force.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A scroll type fluid machine comprising:

a casing;

a fixed scroll which is provided in said casing and is provided in a rising manner with a spiral wrap portion in a surface of a end plate;

a orbiting scroll which is provided in a rising manner with a spiral wrap portion overwrapping the wrap portion of said fixed scroll in a surface of a end plate, and defines a plurality of fluid chambers compressing or expanding a fluid with respect to said fixed scroll on the basis of a orbiting motion;

a drive shaft which has a main shaft portion rotatably provided in said casing via a main bearing and an eccentric shaft portion provided eccentrically in a leading end side of said main shaft portion and attached to said orbiting scroll via a orbiting bearing;

a balance weight which is coupled to said drive shaft and cancels a centrifugal force of said orbiting scroll;

a self-rotation preventing mechanism which prevents a self-rotation of said orbiting scroll; and said self-rotation preventing mechanism being constructed by a first auxiliary crank bearing which is provided in said casing side or the fixed scroll side, a second auxiliary crank bearing which is provided in said orbiting scroll side, and an auxiliary crank shaft in which one side shaft portion is rotatably supported by said first auxiliary crank bearing, and the other side shaft portion is rotatably supported by said second auxiliary crank bearing, wherein a diametrical gap (δb) of said main bearing is larger than a diametrical gap (δa) of said orbiting bearing.

2. A scroll type fluid machine as claimed in claim 1, wherein at least any one of said main bearing and the orbiting bearing is formed by using a ball bearing in which spherical bodies serving as rolling elements are provided between an inner lace and an outer lace.

3. A scroll type fluid machine as claimed in claim 2, wherein said orbiting bearing is provided in a back face side of the end plate of said orbiting scroll.

4. A scroll type fluid machine as claimed in claim 1, wherein at least any one of said main bearing and the orbiting bearing is formed by using a roller bearing in which rollers serving as rolling elements are provided between an inner lace and an outer lace.

5. A scroll type fluid machine as claimed in claim 4, wherein said orbiting bearing is provided in a back face side of the end plate of said orbiting scroll.

6. A scroll type fluid machine as claimed in claim 1, wherein said main bearing is formed by using a slide bearing constructed by a tube member having a self-lubricating characteristic.

7. A scroll type fluid machine as claimed in claim 6, wherein an inner peripheral surface of said slide bearing is formed as a convex curved surface protruding toward an inner side in a radial direction.

8. A scroll type fluid machine comprising:

a casing;

a fixed scroll which is provided in said casing and is provided in a rising manner with a spiral wrap portion in a surface of a end plate;

a orbiting scroll which is provided in a rising manner with a spiral wrap portion overwrapping the wrap portion of said fixed scroll in a surface of a end plate, and defines a plurality of fluid chambers compressing or expanding a fluid with respect to said fixed scroll on the basis of a orbiting motion;

a drive shaft which has a main shaft portion rotatably provided in said casing via a main bearing and an eccentric shaft portion provided eccentrically in a leading end side of said main shaft portion and attached to said orbiting scroll via a orbiting bearing;

a balance weight which is coupled to said drive shaft and cancels a centrifugal force of said orbiting scroll;

a self-rotation preventing mechanism which prevents a self-rotation of said orbiting scroll; and said self-rotation preventing mechanism being constructed by a first auxiliary crank bearing which is provided in said casing side or the fixed scroll side, a second auxiliary crank bearing which is provided in said orbiting scroll side, and an auxiliary crank shaft in which one side shaft portion is rotatably supported by said first auxiliary crank bearing, and the other side shaft portion is rotatably supported by said second auxiliary crank bearing, wherein a diametrical gap (δb) of said main bearing is larger than a difference between a diametrical gap (δa) of said orbiting bearing and a twofold value of an eccentric amount difference (ϵ'−ϵ) between an eccentric amount (ϵ') of said auxiliary crank shaft and an eccentric amount (ϵ) of said drive shaft.

9. A scroll type fluid machine as claimed in claim 8, wherein said first and second auxiliary crank bearings are formed by using an angular bearing which pinches rolling elements between an inner lace and an outer lace in a state in which a preload is given.

10. A scroll type fluid machine as claimed in claim 9, wherein at least any one of said main bearing and the orbiting bearing is formed by using a ball bearing in which spherical bodies serving as the rolling elements are provided between an inner lace and an outer lace.

11. A scroll type fluid machine as claimed in claim 10, wherein said orbiting bearing is provided in a back face side of the end plate of said orbiting scroll.

12. A scroll type fluid machine as claimed in claim 9, wherein at least any one of said main bearing and the orbiting bearing is formed by using a roller bearing in which rollers serving as the rolling elements are provided between an inner lace and an outer lace.

13. A scroll type fluid machine as claimed in claim 12, wherein said orbiting bearing is provided in a back face side of the end plate of said orbiting scroll.

14. A scroll type fluid machine as claimed in claim 9, wherein said main bearing is formed by using a slide bearing constructed by a tube member having a self-lubricating characteristic.

15. A scroll type fluid machine as claimed in claim 14, wherein an inner peripheral surface of said slide bearing is formed as a convex curved surface protruding toward an inner side in a radial direction.

16. A scroll type fluid machine comprising:

a casing;

a fixed scroll which is provided in said casing and is provided in a rising manner with a spiral wrap portion in a surface of a end plate;

a orbiting scroll which is provided in a rising manner with a spiral wrap portion overwrapping the wrap portion of said fixed scroll in a surface of a end plate, and defines a plurality of fluid chambers compressing or expanding a fluid with respect to said fixed scroll on the basis of a orbiting motion;

a drive shaft which has a main shaft portion rotatably provided in said casing via a main bearing and an eccentric shaft portion provided eccentrically in a leading end side of said main shaft portion and attached to said orbiting scroll via a orbiting bearing;

a balance weight which is coupled to said drive shaft and cancels a centrifugal force of said orbiting scroll;

a self-rotation preventing mechanism which prevents a self-rotation of said orbiting scroll; and said self-rotation preventing mechanism being constructed by a first auxiliary crank bearing which is provided in said casing side or the fixed scroll side, a second auxiliary crank bearing which is provided in said orbiting scroll side, and an auxiliary crank shaft in which one side shaft portion is rotatably supported by said first auxiliary crank bearing, and the other side shaft portion is rotatably supported by said second auxiliary crank bearing, wherein a diametrical gap ($\delta b$) of said main bearing is 15 μm or more larger than a difference between a diametrical gap ($\delta a$) of said orbiting bearing and a twofold value of an eccentric amount difference ($\epsilon'-\epsilon$) between an eccentric amount ($\epsilon'$) of said auxiliary crank shaft and an eccentric amount ($\epsilon$) of said drive shaft.

17. A scroll type fluid machine as claimed in claim 16, wherein at least any one of said main bearing and the orbiting bearing is formed by using a ball bearing in which spherical bodies serving as rolling elements are provided between an inner lace and an outer lace.

18. A scroll type fluid machine as claimed in claim 17, wherein said orbiting bearing is provided in a back face side of the end plate of said orbiting scroll.

19. A scroll type fluid machine as claimed in claim 16, wherein at least any one of said main bearing and the orbiting bearing is formed by using a roller bearing in which rollers serving as rolling elements are provided between an inner lace and an outer lace.

20. A scroll type fluid machine as claimed in claim 19, wherein said orbiting bearing is provided in a back face side of the end plate of said orbiting scroll.

21. A scroll type fluid machine as claimed in claim 16, wherein said main bearing is formed by using a slide bearing constructed by a tube member having a self-lubricating characteristic.

22. A scroll type fluid machine as claimed in claim 21, wherein an inner peripheral surface of said slide bearing is formed as a convex curved surface protruding toward an inner side in a radial direction.

* * * * *